US005612771A

United States Patent [19]

Yamamoto et al.

[11] Patent Number: 5,612,771

[45] Date of Patent: Mar. 18, 1997

[54] MULTI-COLOR ELECTROPHOTOGRAPHIC PRINTER HAVING MULTIPLE IMAGE FORMING UNITS FOR CREATING MULTIPLE TONER IMAGES IN REGISTRY

[75] Inventors: Hajime Yamamoto, Osaka; Hiroshi Terada, Ikoma; Masahiko Nakamura, Osaka, all of Japan

[73] Assignee: Matsushita Electric Industrial Co., Ltd., Osaka, Japan

[21] Appl. No.: 285,741

[22] Filed: Aug. 4, 1994

[30] Foreign Application Priority Data

| | | | |
|---|---|---|---|
| Sep. 7, 1993 | [JP] | Japan | 5-221791 |
| Oct. 12, 1993 | [JP] | Japan | 5-254252 |
| Dec. 20, 1993 | [JP] | Japan | 5-319504 |
| Jan. 25, 1994 | [JP] | Japan | 6-006344 |

[51] Int. Cl.[6] ..... G03G 15/01; G03G 15/14

[52] U.S. Cl. ..... 399/301; 399/121; 399/66

[58] Field of Search ..... 355/200, 210, 355/271, 272, 273, 274, 277, 326 R

[56] References Cited

U.S. PATENT DOCUMENTS

| | | | |
|---|---|---|---|
| 4,743,938 | 5/1988 | Ohno | 355/327 |
| 4,887,101 | 12/1989 | Hirose et al. | 346/134 |
| 4,924,267 | 5/1990 | Yoshikawa et al. | 355/210 |
| 5,065,195 | 11/1991 | Haneda et al. | 355/298 |
| 5,126,799 | 6/1992 | Matsuura et al. | 355/298 |
| 5,196,893 | 3/1993 | Nishise et al. | 355/271 |
| 5,198,866 | 3/1993 | Kimura et al. | 355/326 |
| 5,216,256 | 6/1993 | Kusumoto et al. | 250/548 |
| 5,291,252 | 3/1994 | Kawaishi | 355/272 |
| 5,303,014 | 4/1994 | Yu et al. | 355/273 |
| 5,351,115 | 9/1994 | Yamamoto et al. | 355/326 R |
| 5,390,010 | 2/1995 | Yamahata et al. | 355/271 |

FOREIGN PATENT DOCUMENTS

| | | |
|---|---|---|
| 0515053 | 11/1992 | European Pat. Off. . |
| 0552410 | 7/1993 | European Pat. Off. . |
| 4228365 | 3/1993 | Germany . |
| 62-287264 | 12/1987 | Japan . |
| 1-252982 | 10/1989 | Japan . |
| 1-250970 | 10/1989 | Japan . |
| 2-212867 | 8/1990 | Japan . |

*Primary Examiner*—Fred L. Braun

*Attorney, Agent, or Firm*—Pollock, Vande Sande & Priddy

[57] ABSTRACT

A multi-color electrophotographic apparatus is provided which includes a casing having an access cover, an image transfer belt unit for transferring a multi-colored image formed thereon a recording sheet, and an image-forming assembly having a plurality of image-forming units. Each image-forming unit includes a photoconductor and a developer storing therein toner of a single different color for forming a different color toner image on each photoconductor. The image-forming assembly is arranged to be movable between operative and inoperative positions. The operative position is such that each image-forming unit lies at an image-forming station with the photoconductor thereof in engagement with an image transfer belt of the image transfer belt unit to transfer the toner image formed thereon in registration with one another to the image transfer belt for forming the multi-colored image. The inoperative position is such that all the photoconductors of the image-forming assembly are out of engagement with the image transfer belt for allowing an apparatus operator to unload the image transfer belt unit from the casing through the access cover without damaging each photoconductor due to rubbing with the image transfer belt.

15 Claims, 13 Drawing Sheets

MULTI-COLOR ELECTROPHOTOGRAPHIC PRINTER HAVING MULTIPLE IMAGE FORMING UNITS FOR CREATING MULTIPLE TONER IMAGES IN REGISTRY

BACKGROUND OF THE INVENTION

1. Technical Field of the Invention

The present invention relates generally to a multi-color printer, and more particularly concerns an improved structure of a multi-color electrophotographic printer which is designed to be compact and to provide for easy maintenance while assuring machine reliability and performance as well as copy quality.

2. Background Art

In conventional color electrophotography, a multi-colored image may be formed by superimposing yellow, magenta, cyan, and black toner images in registration to a transfer member in two different ways. One is referred to as a transfer drum system wherein different color toner images are sequentially formed on a single photoconductor and then transferred in registration to a transfer member wrapped about a transfer drum. The second is referred to as a successive transfer system wherein different color toner images formed on respective photoconductors are transferred in sequence to a transfer member carried by a belt.

Japanese Patent First Publication No. 1-252982 teaches a conventional transfer drum system which, as shown in FIG. 1, includes a photoconductor 1, a charging unit 2, a developing station 3, a transfer drum 4, and a photoconductor cleaner 5. The developing station 3 includes a Y-developer 6 for forming a yellow toner image, an M-developer 7 for forming a magenta toner image, a C-developer 8 for forming a cyan toner image, and a Bk-developer 9 for forming a black toner image. The developer station 3 rotates to move each developer in sequence into engagement with the photoconductor 1.

In operation, the photoconductor 1 is rotated counterclockwise to have its surface charged uniformly by the charging unit 2. Subsequently, in response to a yellow image-forming signal, a laser beam 10 is radiated to the photoconductor 1 to form an electrostatic latent image which is, in turn, developed by the Y-developer 6 to form a yellow toner image. One copy sheet is fed from a sheet supply station 11 and then wrapped about the periphery of the transfer drum 4 with its leading edge being held by a claw 12 until the yellow toner image formed on the photoconductor 1 is advanced into engagement with the transfer drum. The rotation of the transfer drum 4 is so timed that a specified portion of the copy sheet wrapped about the transfer drum may coincide with the yellow toner image.

The yellow toner image on the photoconductor 1 is transferred to the copy sheet under activities of a transfer charging unit 13. After the image transfer,. the surface of the photoconductor 1 is cleaned by the cleaner 5 for subsequent image transfer operation. Thereafter, magenta, cyan, and black toner images are sequentially formed in the same manner.

The radiation of the laser beam 10 to the photoconductor 1 is so timed that a toner image on the photoconductor may be in registration with a toner image previously transferred to the copy sheet. In this manner, a multi-colored image is printed on the copy sheet wrapped about the transfer drum 4. The image-printed copy sheet is stripped off the transfer drum 4 by a stripper 14 which, in turn, is advanced to a fixing station 16 through a transport path 15.

The above prior art system, however, has suffered from the following drawbacks. The transfer drum 4 needs to have a large enough diameter to wrap the copy sheet therearound and its structure is complex, resulting in a bulky apparatus. In addition, stiff paper such as post cards or thick copy sheets cannot be used because they are difficult to wrap about the transfer drum. Since the transfer drum 4 is separate from the cleaner 35, it is necessary to maintain them individually. Further, the transfer drum has a limited lifetime, and it is difficult to know automatically as to whether the transfer drum has exceeded its lifetime or not. Moreover, the transfer drum 4 constantly contacts the photoconductor, which will cause the photoconductor 1 to be damaged upon replacement of the transfer drum 4 or to be degraded prematurely on exposure to intense light entering from the outside during the replacement.

Japanese Patent First Publication No. 1-250970 discloses a color image forming apparatus using the successive transfer system, as described above, in which four image-forming stations each including a photoconductor, a developer, and a scanner are arranged, and a copy sheet carried on a belt passes through a transfer station provided beneath each photoconductor to form a colored toner image. This prior art apparatus eliminates the need for a transfer drum, however, it requires developers, such as a laser unit, of a number corresponding to the number of colors used, resulting in a complex and expensive arrangement. In addition, the transfer stations are arranged away from one another, yielding positional or angular misalignment thereof. This will cause colors to be shifted, adversely affecting copy quality.

Japanese Patent First Publication No. 2-212867 exemplifies a color printer wherein different color toner images formed in sequence on a photoconductor are temporarily placed in registration on an intermediate transfer member and then transferred together to a copy sheet. In this printer, a plurality of developers need to be arranged around the photoconductor for forming all the different color toner images on the same photoconductor. Therefore, a large-sized photoconductor or a belt-like photoconductor is required which would be difficult to handle by a user. In addition, each developer, when replaced, needs to be matched with properties of the photoconductor. Further, the photoconductor, when replaced, needs to be aligned with each developer.

SUMMARY OF THE INVENTION

It is therefore a principal object of the present invention to avoid the disadvantages of the prior art.

It is another object of the present invention to provide a multi-color electrophotographic printer which is capable of printing images of high quality without misalignment between colors.

It is a further aspect of the invention to provide an improved structure of a multi-color electrophotographic printer which is designed to be compact and to provide for easy maintenance while assuring printer reliability and performance as well as copy quality.

According to one aspect of the present invention, there is provided a multi-color electrophotographic apparatus which comprises a casing, a plurality of image-forming units each including a photoconductor and a developer having toner of a single different color for forming a different color toner image. Each photoconductor is rotatable about a given axis of rotation. A rotary image-forming assembly is provided including the image-forming units, a driving means for rotating the image-forming assembly to move the image-forming units, in sequence, to an image-forming station. Also an exposure means provides a light-signal to the image-forming assembly. An optical orientation means is arranged at a central portion of the rotary image-forming assembly, for orienting the light-signal from the exposure means toward the photoconductor of each image-forming unit positioned at the image-forming station for forming a toner image of a different color thereon. Also, a transfer belt is arranged to move through the image-forming station to transfer thereon the toner image formed on each photoconductor in registration with one another to form a multi-color toner image. A transfer means transfers the multi-color toner image formed on the transfer belt to a recording sheet. A transfer belt unit having disposed therein the transfer belt and a cleaner for cleaning a surface of the transfer belt is arranged in the casing detachably therefrom, in a direction substantially perpendicular to the given axis of rotation of the photoconductor of each image-forming unit.

In the preferred mode, the transfer belt unit may further include a waste toner chamber for storing therein waste toner deposited on the transfer belt cleaned by the cleaner.

According to another aspect of the invention, there is provided a multi-color electrophotographic apparatus which comprises a image-transferring member and a rotary image-forming assembly having a plurality of image-forming units, each including a photoconductor and a developer storing toner of a single different color for forming a different color toner image and being movable between operative and inoperative positions. The operative position is such that each image-forming unit is displaced outward of a periphery of the image-forming assembly into engagement with the image-transferring member at an image forming station to transfer the toner image formed thereon, in registration with one another, to the image-transferring member for forming a multi-colored image. The inoperative position is such that each image-forming unit lies inside the periphery of the image-forming assembly out of engagement with the image-transferring member, and a driving means for rotating the image-forming assembly to move the image-forming units, in sequence, to the image-forming station, the driving means having each image-forming unit assume the inoperative position during the movement to the image-forming station.

In the preferred mode, each image-forming unit assumes the inoperative position when the apparatus is out of an image-forming operation for allowing the image-forming assembly to be unloaded from an apparatus casing.

According to a further aspect of the invention, there is provided a multi-color electrophotographic apparatus which comprises a rotary image-forming assembly including a plurality of image-forming units each having a photoconductor and a developer having toner of a single different color for forming a different color toner image on the photoconductor. Also, a driving means rotates the image-forming assembly to move the image-forming units, in sequence, to an image-forming station. A transfer member unit is provided having disposed therein a transfer member, a cleaner, and a waste toner chamber. The transfer member is arranged to transfer thereon at the image-forming station the toner image formed on each photoconductor for forming a multi-colored image The cleaner cleans the transfer member by collecting waste toner deposited on the transfer member in the waste toner chamber capacity of the waste toner chamber is determined that the waste toner chamber becomes filled with the waste toner before the transfer member exceeds its lifetime.

In the preferred mode, a toner sensor may further be mounted in the transfer member unit to monitor the amount of the waste toner collected in the waste toner chamber.

Additionally, a position sensor may be provided for detecting an image-forming starting position of the transfer member to provide a position signal indicative thereof. The transfer member is controlled in response to the position signal to transfer thereon the toner image formed on each photoconductor in registration with one another for forming the multi-colored image.

According to a still further aspect of the invention, there is provided a transfer member unit for use in a multi-color electrophotographic apparatus including an image-forming assembly having a plurality of image-forming units each including a photoconductor and a developer having toner of a single different color for forming a different color toner image on the photoconductor. A driving means moves the image-forming assembly to displace the image-forming units, in sequence, to an image-forming station, which comprises a transfer member for transferring at the image-forming station the toner image formed on each photoconductor thereto in registration with one another to form a multi-colored image. A waste toner chamber stores therein waste toner deposited on the transfer member, and a waste toner sensor monitors the amount of the waste toner stored in the waste toner chamber.

According to a yet further aspect of the invention, there is provided a transfer belt unit for use in a multi-color electrophotographic apparatus including an image-forming assembly having a plurality of image-forming units. Each image forming unit has a photoconductor and a developer having toner of a single different color for forming a different color toner image on the photoconductor. A driving means moves the image-forming assembly to displace the image-forming units, in sequence, to an image-forming station. The driving means includes a transfer belt for transferring at the image-forming station the toner image formed on each photoconductor thereto in registration with one another for forming a multi color toner image, a first transfer roller bringing the transfer belt into engagement with each photoconductor lying at the image-forming station. A second transfer roller urges the transfer belt to form a nip between the transfer belt and transferring means provided in the multi-color electrophotographic apparatus. A recording medium passes through the multi-color electrographic apparatus to transfer the multi color toner image formed on the transfer belt to the recording medium, and a tension roller provides tension to the transfer belt to maintain the transfer belt stretched to a given degree.

In the preferred mode, the first transfer roller is made of a conductive and elastic material. The tension roller is supported by a shaft which is so mounted on a housing of the transfer belt unit as to be displaced to maintain a given degree of tension over the transfer belt. In addition, a roller may be arranged coaxially with the first transfer roller, which has a smaller diameter than that of the first transfer roller to restrict a degree of engagement of the first transfer roller with each photoconductor through the transfer belt at the image-forming station.

According to a further aspect of the invention, there is provided a multi-color electrophotographic apparatus which comprises a casing having an access cover, an image-transferring means for transferring a multi-colored image formed thereon to a recording sheet, and an image-forming assembly having a plurality of image-forming units. Each image forming unit includes a photoconductor and a developer storing toner of a single different color for forming a different color toner image on each photoconductor. The image-forming assembly is arranged to be movable between operative and inoperative positions. The operative position is such that each image-forming unit lies at an image-forming station with the photoconductor thereof in engagement with the image-transferring means to transfer the toner image formed thereon in registration with one another to the image-transferring means for forming the multi-colored image. The inoperative position is such that all the photoconductors of the image-forming assembly are out of engagement with the image transferring means for allowing the image-transferring means to be unloaded from the casing through the access cover.

In the preferred mode, the image-forming assembly has the image-forming units arranged in a circle. A driving means is provided for rotating the image-forming assembly to move the image-forming units, in sequence, between the operative position and the inoperative position. Each image-forming unit supports the photoconductor rotatably about a given axis of rotation. The image-transferring means is so arranged in the casing as to be withdrawn through the access cover in a direction perpendicular to the axis of rotation of each photoconductor.

Alternatively, the image-forming assembly may have the image-forming units arranged in a straight line. In this arrangement, a driving means is provided for moving the image-forming assembly along a given linear path to displace the image-forming units, in sequence, between the operative position and the inoperative position. Each image-forming unit supports the photoconductor rotatably about a given axis of rotation. The image-forming assembly is so arranged in the casing as to be withdrawn through the access cover in a direction parallel to the axis of rotation of each photoconductor.

Additionally, the image-forming assembly may have the image-forming units arranged in a circle. A driving means may further be provided for rotating the image-forming assembly to move the image-forming units sequentially into alignment with the image-transferring means and displacing each image-forming unit outward in a radial direction into engagement with the image-transferring means to assume the operative position.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings.

DESCRIPTION OF THE PREFERRED EMBODIMENT

Figure 1:
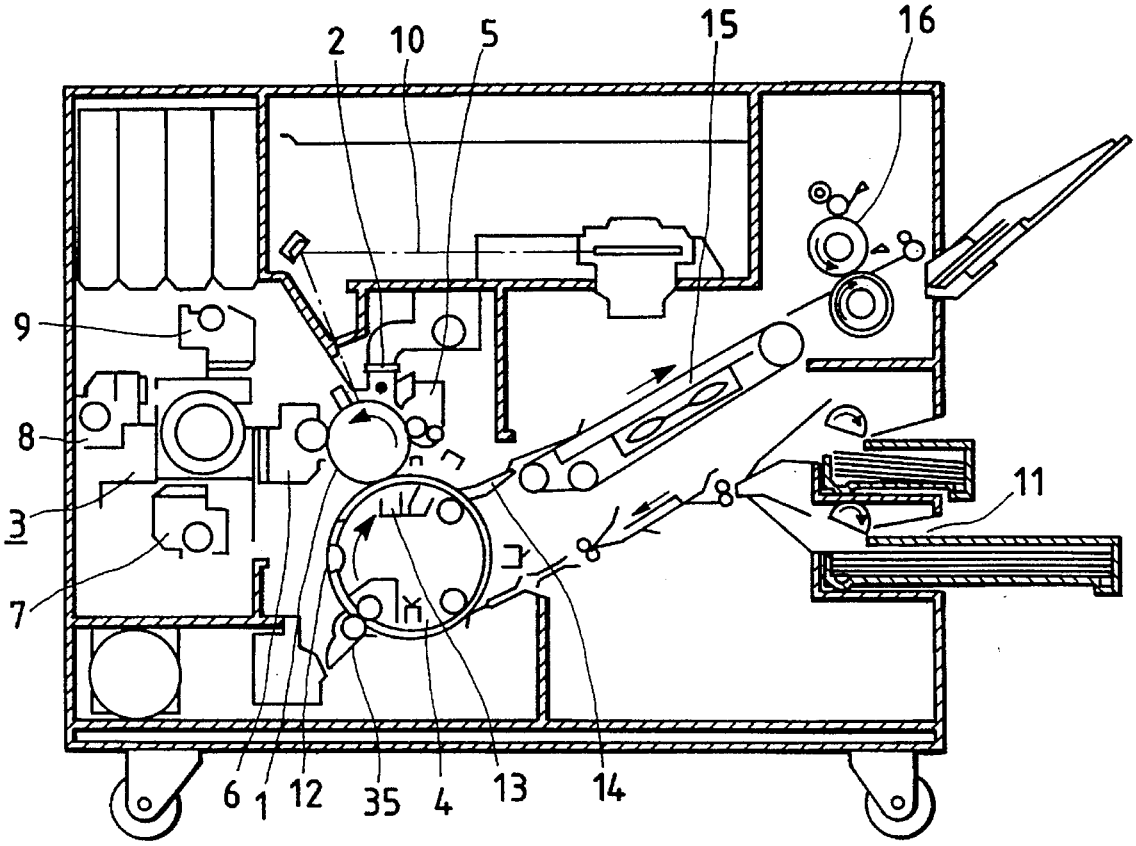
FIG. 1 PRIOR ART
FIG. 1 is a cross-sectional view which shows a prior art color printer.
Figure 2:
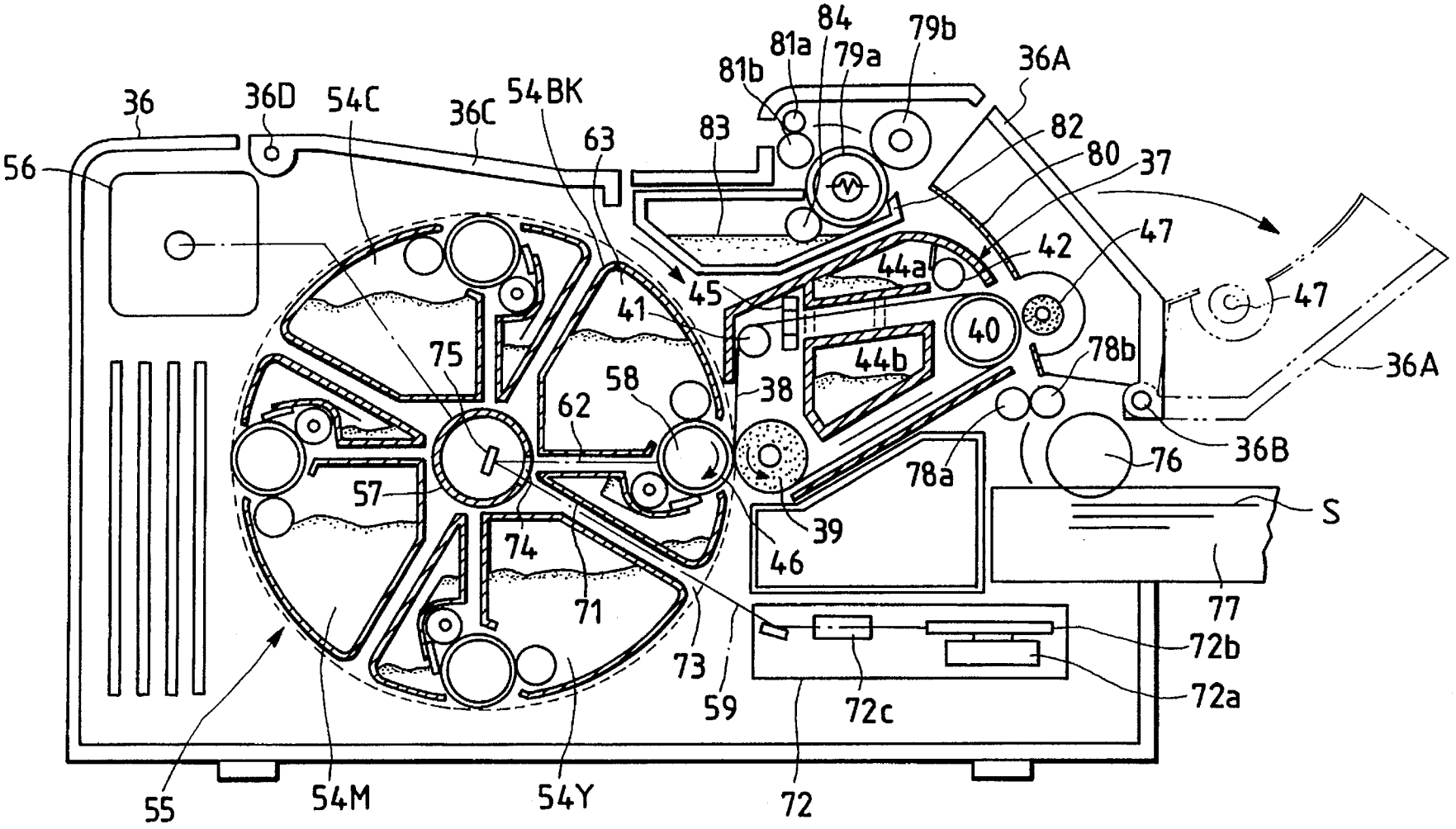
FIG. 2 is a cross-sectional view which shows a multi-color electrophotographic printer according to the present invention.

Referring now to the drawings, wherein like numbers refer to like parts in several views, particularly to FIG. 2, there is shown a multi-color electrophotographic printer which may employed in a color facsimile machine, for example.

The electrophotographic printer includes generally a printer casing 36, a front access cover 36A, and an intermediate transfer belt unit 37. The front access cover 36A is pivotably supported by a hinge shaft 36B so that it may be opened downward, as shown by a broken line, for allowing a printer operator to withdraw the intermediate transfer belt unit 37 or to remove a jammed sheet out of the printer casing 36. When loading and unloading the intermediate transfer belt unit 37 into and out of the printer casing 36, it is oriented in a direction perpendicular to an axis of rotation of each photoconductor drum 46.

Figure 3:
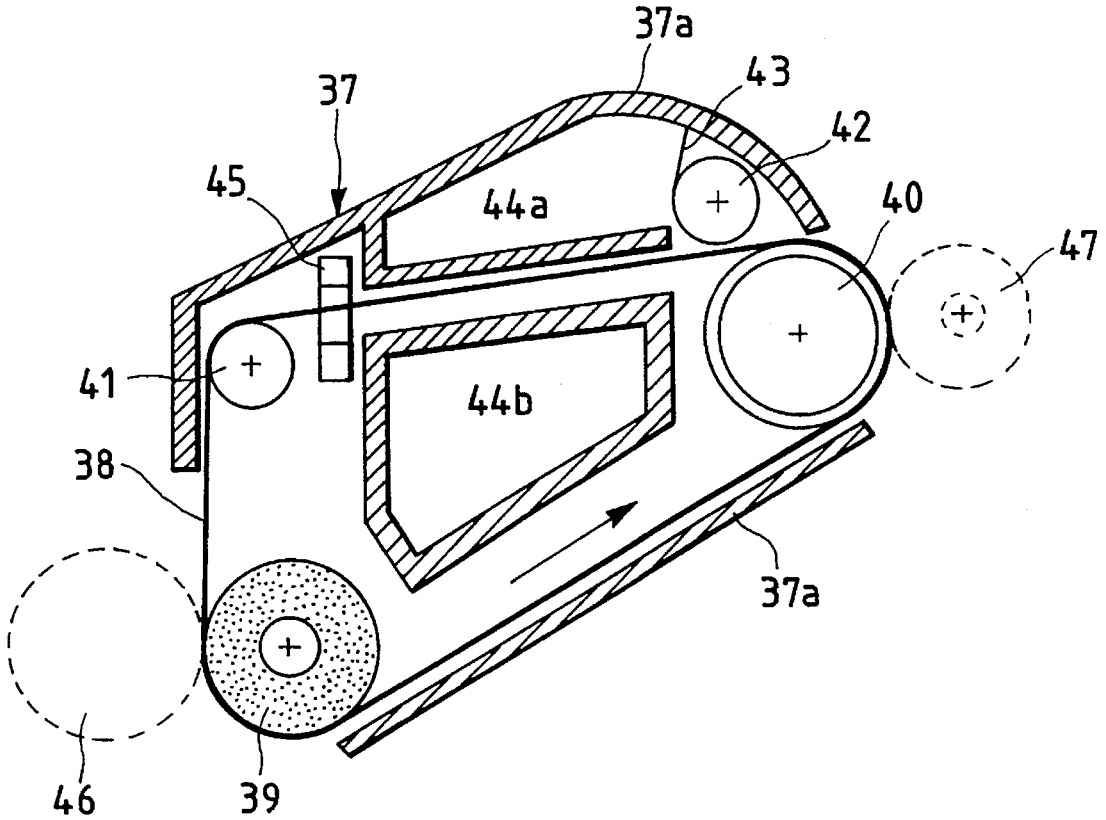
FIG. 3 is a cross-sectional view which shows an intermediate transfer belt unit employed in a printer of the invention.

Referring to FIG. 3, there is shown the intermediate transfer belt unit 37 which includes a unit housing 37*a*, an intermediate transfer belt 38, a first transfer roller 39 made of a conductive and elastic material, a second transfer roller 40 made of aluminum, a tension roller 41 for providing tension to the transfer belt 38 to maintain it stretched at constant level. A belt cleaner roller 42 is provided for cleaning residual toner particles remaining on the transfer belt 38 toner scraper 43 scrapes the toner particles deposited on the belt cleaner roller 42, and toner chambers 44*a* and 44*b* store the toner particles collected by the toner scraper 43. A position sensor 45 monitors a position of the transfer belt 38 to provide a signal indicative of an image-forming starting position. The intermediate transfer belt unit 37 is, as mentioned above, mounted in the printer casing 36 detachably by opening the front access cover 36A.

The intermediate transfer belt 38 is formed with a 100μ-thick endless belt-like film made of a semi-conductive urethane base material. The first and second transfer rollers 39 and 40 each have a lower resistance layer, made of urethane foam, formed on their peripheral surfaces. The intermediate transfer belt 38 is wound around the first and second transfer rollers 39 and 40 so that it may travel in a direction indicated by an arrow, and has a circumference of 400 mm which corresponds to the sum of length (298 mm) of an A4 size sheet which is a maximum size in recording sheets employed in this printer and a value (102 mm) longer than half of a circumference of the photoconductor drum 46 having a diameter of 30 mm by a predetermined length.

The first transfer roller 39 has a resistance of $10^7$ Ωcm, and is urged against the photoconductor 46 through the intermediate transfer belt 38 under a pressure of 1.0 kg. A third transfer roller 47 which has the same construction as that of the first transfer roller 39, engages the second transfer roller 40 through the intermediate transfer belt 38 so that it may follow rotation of the second transfer roller 40.

The cleaner roller 42 is designed to apply an AC voltage to electrostatically attract toner particles deposited on a surface of the intermediate transfer belt 38.

Figure 4:
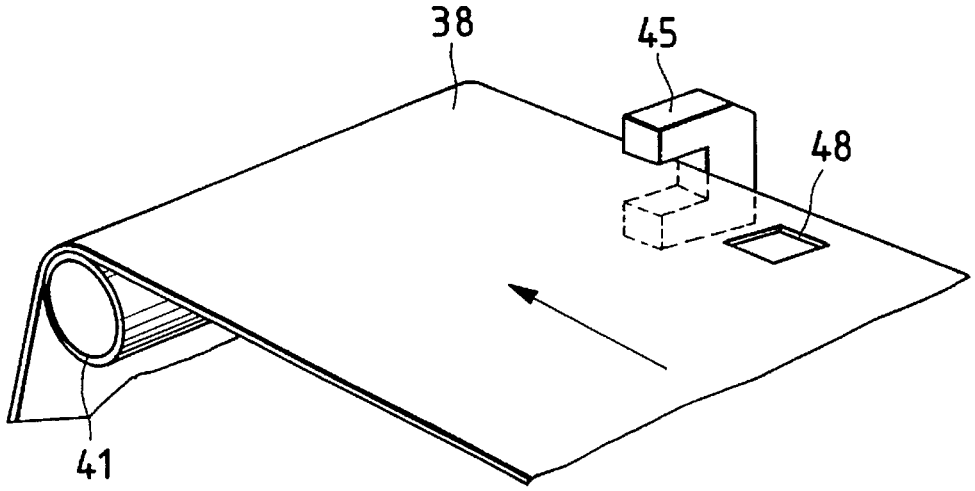
FIG. 4 is a perspective view which shows a position sensor for monitoring a position of a transfer belt.

The position sensor 45 is, as shown in FIG. 4, of C-shape and is arranged to optically detect the passage of an opening 48 formed in a side portion of the intermediate transfer belt 38 for achieving registration of color toner images on the intermediate transfer belt 38.

Figure 5:
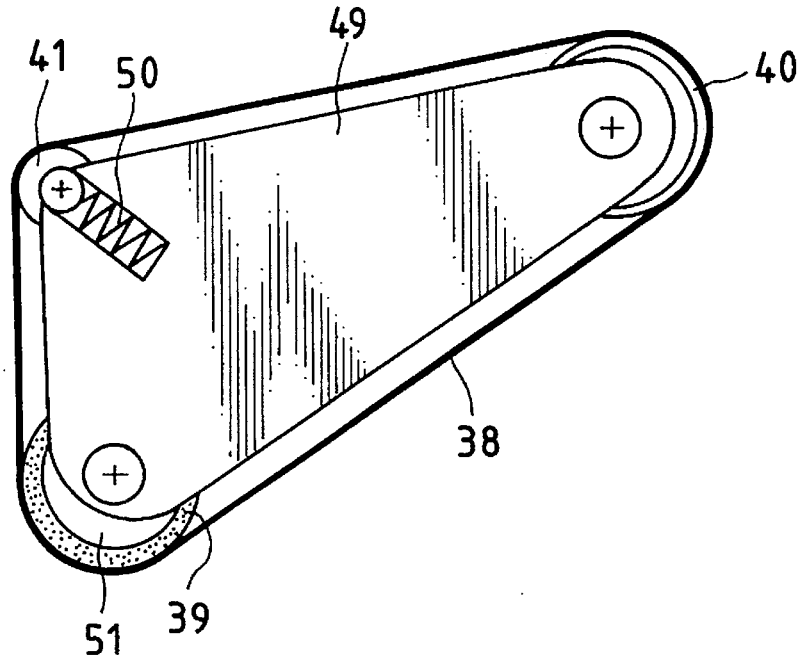
FIG. 5 is a side view which shows an arrangement designed to provide tension to an intermediate transfer belt.
Figure 6:
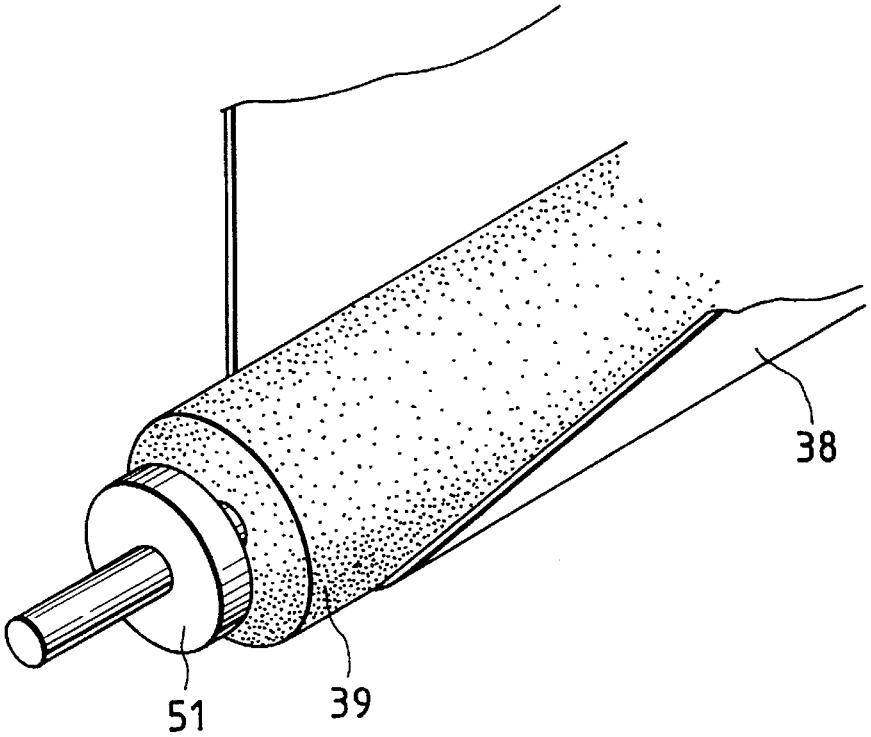
FIG. 6 is a perspective view which shows a structure of a transfer roller employed in an intermediate transfer belt unit.

FIG. 5 shows a mounting structure for three rollers of the intermediate transfer belt unit 37. The first transfer roller 39 having a diameter of 30 mm, the second transfer roller 40 having a diameter of 30 mm, and the tension roller 41 having a diameter of 12 mm, are rotatably retained by a side plate 49. The tension roller 41 is urged by a coil spring 50 to provide constant tension to the intermediate transfer belt 38. Rollers 51, as shown in FIG. 5, are arranged on both sides of the first transfer roller 39 coaxially therewith (only one is shown for the sake of simplicity). Each roller 51 has a diameter of 28 mm smaller than that of the first transfer roller 39 by 2 mm.

Figure 7:
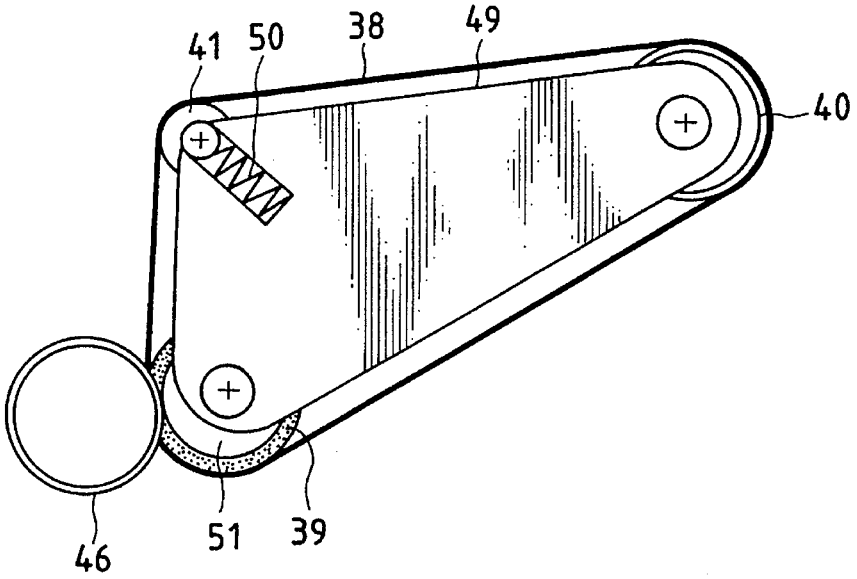
FIG. 7 is a side view which shows engagement of a photoconductor with an intermediate transfer belt.

As shown in FIG. 7, the photoconductor 46 disposed in each image-forming unit is, as discussed above, pressed at an image-forming station against the first transfer roller 39 through the intermediate transfer belt 38. The degree of this pressure, or engagement is restricted by the rollers 51 to form a constant nip through which the intermediate transfer belt 38 passes. The intermediate transfer belt 38 thus stretched generally tends to loosen with use. The spring 50, however, constantly pushes the tension roller 41 so as to provide the intermediate transfer roller 39 with constant tension, thereby allowing toner images formed on the photoconductor 46 to be transferred uniformly onto the intermediate transfer belt 38 without color misalignment which may be caused by reduction in tension of the intermediate transfer belt 38.

Referring back to FIG. 2, an annular image-forming assembly 55 is disposed at the center of the printer casing 36. The image-forming assembly 55 has four individual fan-shaped image-forming units 54Bk, 54Y, 54M, and 54C arranged in circle which store black, cyan, magenta, and yellow toner particles, respectively. Each image-forming unit can be loaded into and unloaded from the image-forming assembly 55 by opening an upper access cover 36C about a hinge 36D. Upon loading into the image-forming assembly 55 in place, each image-forming unit is connected to a driving system and an electric system of the printer through couplings (not shown).

The image-forming units 54Bk, 54Y, 54M, and 54C are retained by a retainer (not shown) rotatably around a hollow shaft 57 fixed on the printer casing 36, and are so driven by a motor 56 through a gear train (not shown) that they are moved sequentially toward an image-forming station 58 into engagement with the first transfer roller 39 of the intermediate transfer belt unit 37. The image-forming station 58 also serves as an exposure station to a light-signal 59.

Each image-forming unit 54Bk, 54Y, 54M, and 54C is substantially identical. The primary distinction between them is the color of toner particles contained therein. Thus, only the features and components of a single image-forming unit will be described in detail for the sake of simplicity.

Figure 8:
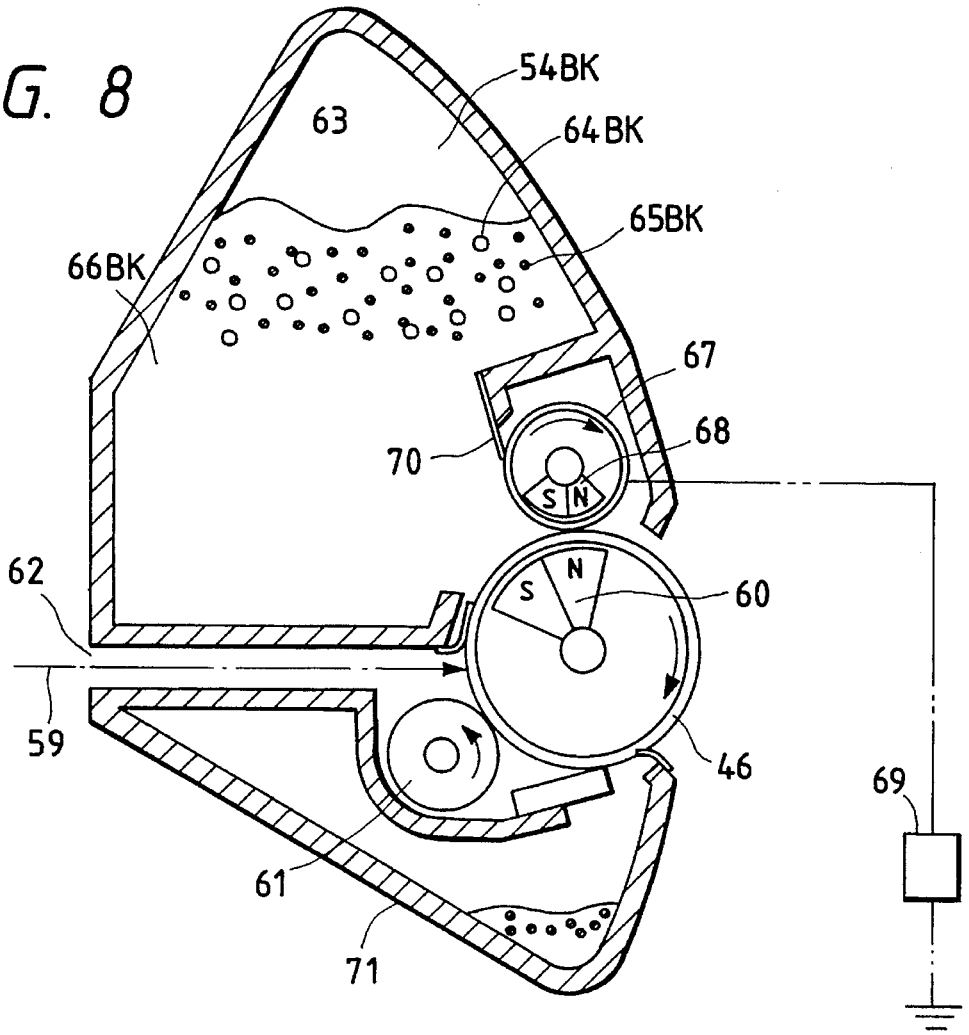
FIG. 8 is a partial cross-sectional view which shows an image-forming unit of an image-forming assembly which stores black toner particles.

Referring to FIG. 8, an individual image-forming unit, as for example, the image-forming unit 54Bk includes an organic photoconductor 46, a stationary magnet 60 arranged coaxially with the photoconductor 46, a charging roller 61 for establishing negative charges on the photoconductor, an exposure aperture 62 through which a scanning laser beam 59 enters the image-forming unit, and a toner hopper 63. The photoconductor 46 is formed with a polycarbonate binder resin in which phthalocyanine is dispersed. The toner hopper 63 stores therein a two-component developing material 66Bk consisting of a mixture of ferrite carrier beads 64Bk, having a particle size of 50 μm, coated with a silicone resin and toner particles 65Bk formed by mixing a black pigment with a polyester resin. This developing material adheres to a surface of the photoconductor 46 under magnetic force created by the magnet 60.

The image-forming unit 54Bk further includes an aluminum-made rotary electrode roller 67, a stationary magnet 68 mounted in the roller 67 coaxially therewith, an ac high voltage source 69 for applying a voltage to the electrode roller 67, a polyphenylene sulphite-made scraper 70 for scraping toner particles off the electrode roller 67, and a cleaner 71 for cleaning toner particles remaining on the photoconductor 46 after a transferring operation. The photoconductor 46 has a diameter of 30 mm and rotates clockwise, as viewed in the drawing, at a peripheral speed of 60mm/s. The electrode roller 67 has a diameter of 16 mm and rotates clockwise at a peripheral speed of 60 mm/s.

Referring back to FIG. 2 again, a laser beam scanner 72 is disposed on an lower portion of the printer casing 36. The laser beam scanner 72 includes a semiconductor laser scanner motor 72*a*, a polygon mirror 72*b*, and a lens system 72*c*. The scanner 72 provides time-sequential electric pixel information signals in the form of a laser beam 59 which, in turn, is directed onto a mirror 75 arranged in the hollow shaft 57 through an aperture 73 defined between the image-forming units 54Bk and 54Y and an aperture 74 formed in the shaft 57. The beam reflected on the mirror 75 then enters the image-forming unit 54Bk through the exposure aperture 62 and travels horizontally through an optical path defined between the toner hopper 63 and the cleaner 71 to arrive at a developing station on a left side of the photoconductor 46 so that it scans in a direction of a generatrix of the photoconductor for exposure.

The optical path from the aperture 73 and the mirror 75 is, as clearly shown from the drawing, defined in a clearance between the image-forming units 54Bk and 54Y arranged adjacent each other, therefore, there is almost no dead space in the image-forming assembly 55. Additionally, the provision of the mirror 75 at the center of the image-forming assembly 55 eliminates the need for a plurality of mirrors, resulting in a simple structure and easy alignment.

The third transfer roller 47 is arranged inside the front access cover 36A and above a sheet feed roller 76. The third transfer roller 47, as already mentioned, engages the intermediate transfer belt 38 to form a nip through which a copy sheet is fed by the sheet feed roller 76 along a sheet feed path.

The printer further includes a sheet cassette 77, a pair of sheet feed timing rollers 78*a* and 78*b*, a pair of fixing rollers 79*a* and 79*b* arranged at an upper portion thereof, a sheet guide plate 80, a pair of sheet-ejecting rollers 81*a* and 81*b*, a silicone oil reservoir 82, and an oil supply roller 84. The sheet cassette 77 stores therein a stack of copy sheets S and is inserted into the printer casing 36 with a portion thereof projecting from the front access cover 36A. The sheet guide plate 80 extends between the third transfer roller 47 and the fixing rollers 79*a* and 79*b*. The sheet-ejecting rollers 81*a* and 81*b* eject a copied sheet emerging from the fixing rollers 79*a* and 79*b* outside the printer. The silicone oil reservoir 82 stores therein a silicone oil 83 to supply it to the fixing roller 79*a* through the oil supply roller 84.

The above arrangements eliminate the need for a complex structure of a transfer drum as well as an arrangement for optical alignment of an image-exposure system, and provides a simple and compact multi-color electrophotographic printer which is capable of accurately positioning toner images of different colors.

Further, in a conventional arrangement wherein an intermediate transfer member cleaner is mounted on a printer body and only an intermediate transfer belt is replaced, the intermediate transfer belt may be disposed in the printer body out of alignment with the cleaner, causing the cleaner to fail to clean the intermediate transfer belt. In contrast, the printer of this invention, the intermediate transfer belt 38 is assembled in the unit housing 37*a* together with the cleaner 53 for holding a positional relation therebetween, thereby ensuring stable cleaning of the transfer belt.

Additionally, the intermediate transfer belt unit 37 is designed to slide out in a direction perpendicular to an axis of rotation of each photoconductor 46 (i.e., a direction to the right-hand upper side in FIG. 2). This arrangement avoids a rub of the intermediate transfer belt 38 on the photoconductor 46 when the intermediate transfer belt unit 37 is replaced, so that the photoconductor is not damaged. In addition, a jammed sheet is easily removed by opening the front access cover 36A and withdrawing the intermediate transfer belt unit 37 from the printer.

An operation of the multi-color electrophotographic printer will be discussed below with reference to FIGS. 2, 3, and 8.

First, the formation of a black toner image is explained with reference to FIG. 8.

The photoconductor 46 is first charged to −500 V by the charging roller 61. The laser beam scanner 72 then emits the laser beam 59 to the photoconductor 46 to form an electrostatic latent image at an exposure voltage of −100 V. Under a magnetic force in the toner hopper 63, the two-component developing material 66Bk adheres onto the surface of the photoconductor 46. Subsequently, the photoconductor 46 is advanced to the electrode roller 67. During passage of an uncharged portion of the photoconductor 46, the high voltage source 69 applies to the electrode roller 67 an ac voltage (a rectangular wave at a frequency of 3 kHz) of 750 $V_{O\text{-}P}$ (a peak-to-peak voltage of 1.5 kV) on which a dc voltage of +100 V is superimposed. During passage of the −500 V-charged portion of the photoconductor 46 on which the latent image is formed, the high voltage source 69 provides to the electrode roller 67 an ac voltage (a rectangular wave at a frequency of 3 kHz) of 750 $V_{O\text{-}P}$ (a peak-to-peak voltage of 1.5 kV) on which a dc voltage of −300 V is superimposed. This causes the developing material on the photoconductor 46 and the toner particles adhering to a non image-formed portion of the photoconductor to be withdrawn by the electrode roller 67 to form a toner image which is negative-to-positive reversed on the latent image-formed portion of the photoconductor 46. The developing material and the toner particles adhering to the surface of the electrode roller 67 are collected by the scraper 70 into the toner hopper 63 for subsequent re-use. A black toner image is thus formed on the photoconductor 46. Other colored toner images, i.e., cyan, magenta, and yellow toner images are formed by the image-forming units 54C, 54M, and 54Y in the same manner.

Referring to FIG. 2, at the start of the above discussed image-forming operation, the black image-forming unit 54Bk is positioned at the image-forming station 58. The photoconductor 46, as shown in FIG. 7, presses the first transfer roller 39 through the intermediate transfer belt 38 to bring its side portions into contact with the rollers 51. The intermediate transfer belt 38 is tensed by the tension roller 41.

When the black toner image is formed, the laser beam scanner 72, as stated above, outputs a black light-signal (i.e., the laser beam 59) to the black image-forming unit 54Bk to form an electrostatic latent image on the photoconductor 46 which is, in turn, toned with black toner particles. The image-forming unit 54Bk then rotates the photoconductor 46 at a speed equal to a traveling speed of the intermediate transfer belt 38 so that the black toner image formed on the photoconductor 46 is transferred to the intermediate transfer belt 38 under activities of the first transfer roller 39. After completion of the transfer of the black toner image, the image-forming assembly 55 is turned by the motor 56 through an angle of 90 deg. in a clockwise direction, as viewed in FIG. 2, so that the next image-forming unit 54C reaches the image-forming station 58. During the rotation of the image-forming assembly 55, component parts of each image-forming unit other than the photoconductor 46 are held out of engagement with the intermediate transfer belt 38 since each photoconductor 46 slightly projects from an outer surface of the image-forming assembly 55 into engagement with the first transfer roller 39.

When the image-forming unit 54C arrives at the image-forming station 58, the laser beam scanner 72 provides a cyan light-signal thereto to form a cyan toner image which is, in turn, transferred to the intermediate transfer belt 38 in the same manner as that of forming the black toner image discussed above. During this process, the intermediate transfer belt 38 makes its complete turn and the timing of writing the cyan light-signal on the photoconductor 46 is controlled based on a sensor signal from the position sensor 45 so that the cyan toner image may be brought into registration with the black toner image transferred to the intermediate transfer belt 38 in the previous transfer cycle.

The above image-forming process is repeated for magenta and yellow. In this manner, successive electrostatic latent images are developed with different colored toner particles and then transferred to the intermediate transfer belt 38 in superimposed registration with one another to form a multi-colored image thereon.

After the last yellow toner image has been transferred to the intermediate transfer belt 38, the copy sheet S is fed from the sheet cassette 77 to the nip (i.e., a printing station) formed between the second transfer roller 40 and the third transfer roller 47 with proper timing so that the multi-colored image is printed thereon and then fixed by the fixing rollers 79*a* and 79*b*. The image-copied sheet is then ejected out of the printer through the sheet-ejecting rollers 81*a* and 81*b*. The toner remaining on the intermediate transfer belt 38 is cleaned by the belt cleaner roller 42 for a subsequent image-forming operation.

In a monochromatic printing mode of operation, one of the image-forming units 54Bk, 54C, 54M, and 54Y of a desired color is first moved to the image-forming station 58. In the same manner as discussed above, a single color toner image is formed and transferred to the intermediate transfer belt 38, printed through the third transfer roller 47 on a copy sheet supplied from the sheet cassette 77, and then is fixed by the fixing rollers 79*a* and 79*b*.

When a developing material of a particular color is consumed completely and the image-forming unit of that color is replaced, the motor 56 is activated to rotate the image-forming assembly 55 to move the image-forming unit upward. The upper cover 36C is then opened to unload the image-forming unit from the printer casing 36. Subsequently, a new image-forming unit wherein the print density of a developing material has been adjusted, is loaded into the printer. This allows the image-forming process to be initiated without the need for any adjustments after the new image-forming unit has been loaded.

The intermediate transfer belt 38 may be used for about 30,000 printing cycles. Waste toner particles produced during this period are collected in the waste toner chambers 44*a* and 44*b*. The printer operator may open the front access cover 36A to gain access to the intermediate transfer belt unit 37 for replacement thereof. It is advisable that toner-storing capacity of the waste toner chamber 44*b* be so determined that it becomes filled with the waste toner particles before the end of the intermediate transfer belt 38 life.

Figure 9:
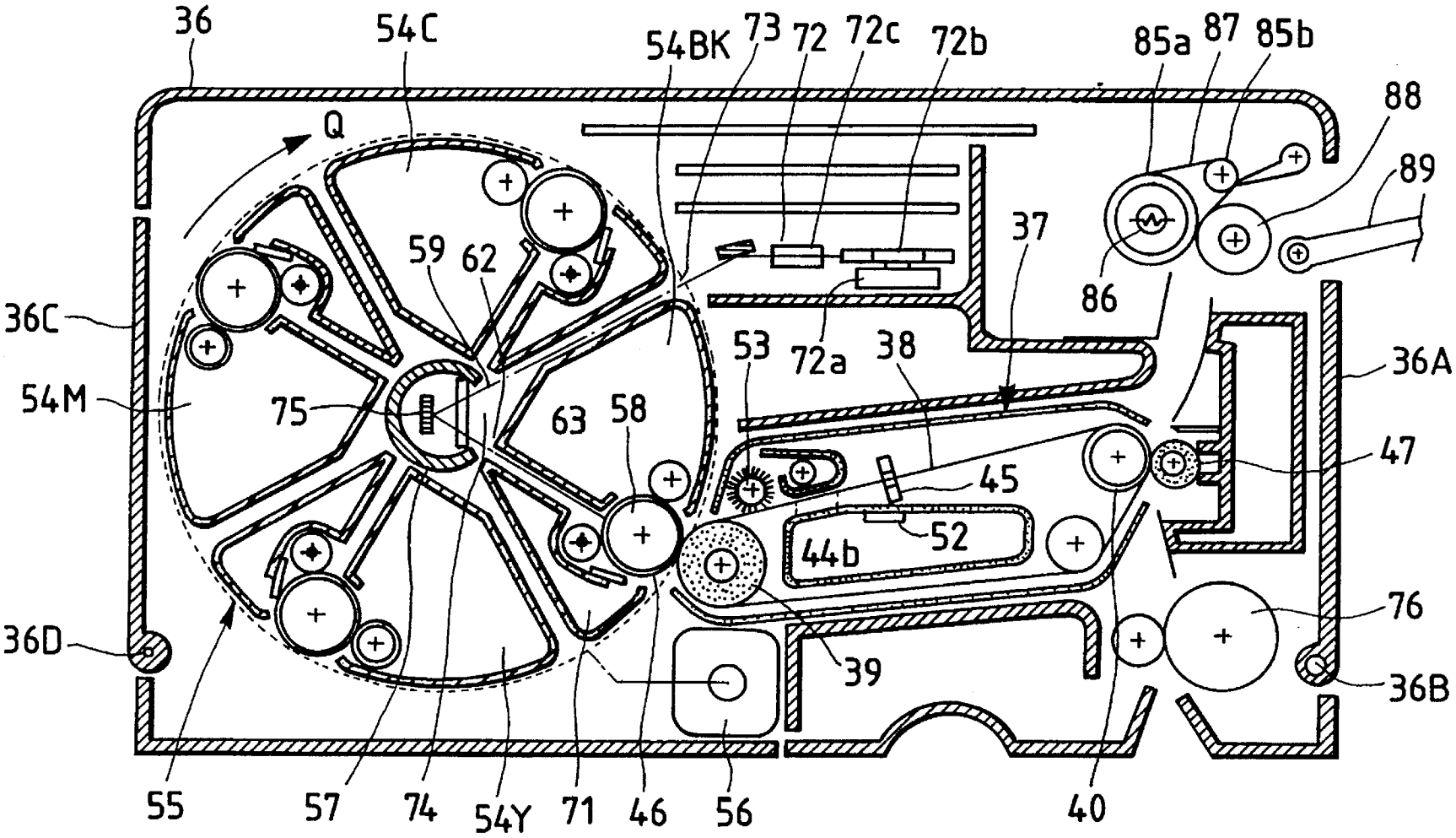
FIG. 9 is a cross-sectional view which shows a second embodiment of a multi-color electrophotographic printer of the invention.
Figure 10:
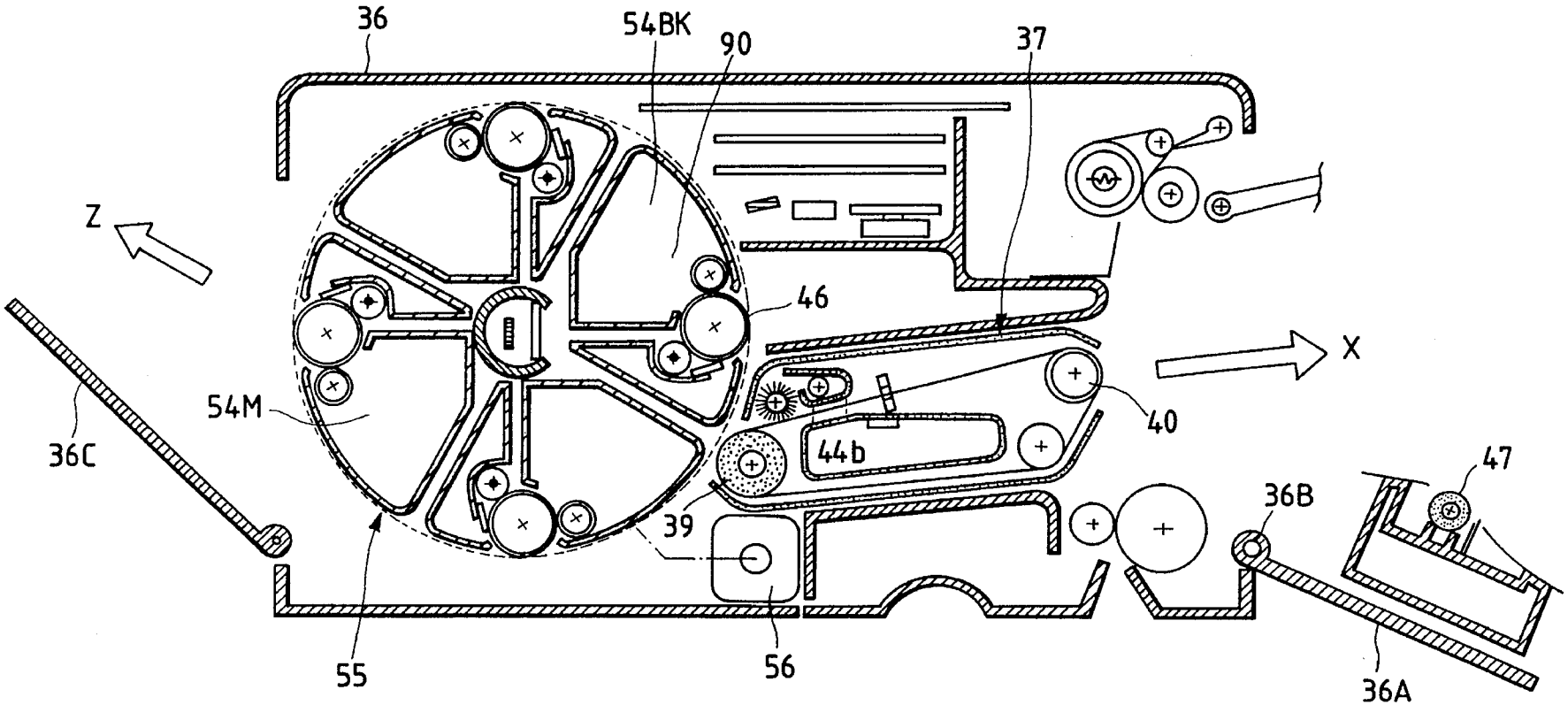
FIG. 10 is a cross-sectional view which illustrates a structure of a printer casing wherein right and left access covers are opened for replacement of an intermediate transfer belt unit and an image-forming assembly.
Figure 11:
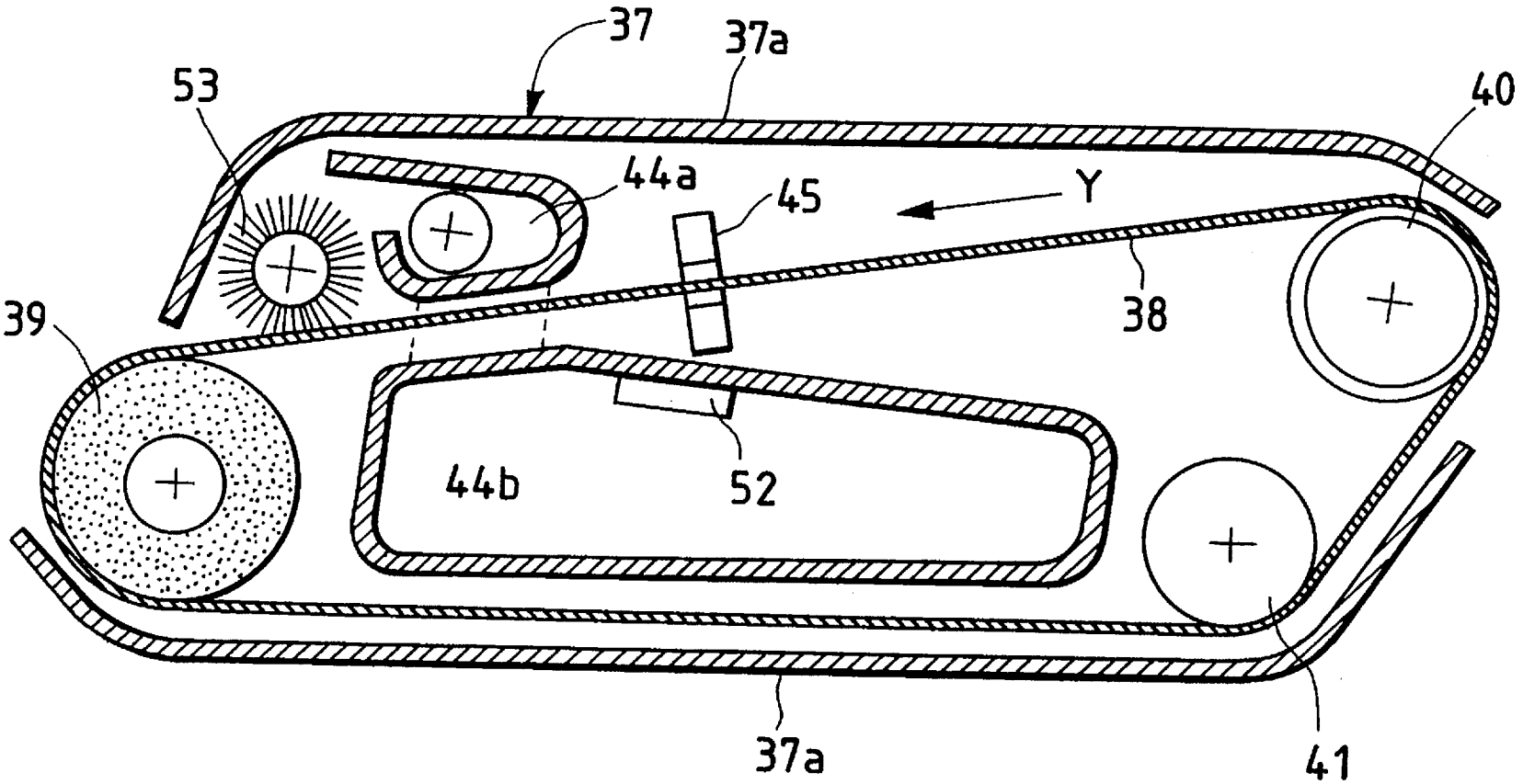
FIG. 11 is a cross-sectional view which shows an intermediate transfer belt unit of a second embodiment.

Referring to FIGS. 9, 10, and 11, there is shown an alternative embodiment of the multi-color electrophotographic printer of the invention.

A printer casing 36 has a front access cover 36A and a rear access cover 36C. The front access cover 36A is, as shown in FIG. 10, pivotably supported by a hinge shaft 36B for allowing the printer operator to gain access to the inside of the printer casing 36 for removal of a jammed sheet or loading and unloading of an intermediate transfer belt unit 37.

The intermediate transfer belt unit 37 is, as shown in FIG. 10, loaded into the printer casing 36 with a first transfer roller 39 being out of engagement with each photoconductor 46. When the front access cover 36A is closed, it will cause a second transfer roller 47 to be urged against a third transfer roller 47 through an intermediate transfer belt 38. The third transfer roller 47 is designed to follow traveling of the intermediate transfer belt 38.

An image-forming assembly 55, similar to the first embodiment, includes four individual fan-shaped image-forming units 54Bk, 54Y, 54M, and 54C which store therein black, cyan, magenta, and yellow toner particles, respectively. Each image-forming unit can be loaded into and unloaded from the image-forming assembly 55 by opening the rear access cover 36C, as shown in FIG. 10, about a hinge 36D. When arranged in the image-forming assembly 55 in place, each image-forming unit is connected to a driving system and an electric system of the printer through couplings (not shown).

The image-forming units 54Bk, 54Y, 54M, and 54C are retained by a retainer (not shown) rotatably around a hollow shaft 57 fixed on the printer casing 36, and are so driven by a motor 56 through a gear train (not shown) that they are moved sequentially toward an image-forming station 58 into engagement with the first transfer roller 39 of the intermediate transfer belt unit 37. The image-forming station 58 also serves as an exposure station to a light-signal 59.

Referring to FIG. 11, the intermediate transfer belt 38 is, similar to the above embodiment, formed with a 100μ-thick endless belt-like film made of a semi-conductive urethane base material. The first and second transfer rollers 39 and 40 each have a lower resistance layer, made of urethane foam, formed on their peripheral surfaces. The intermediate transfer belt 38 is wound around the first and second transfer rollers 39 and 40 and a tension roller 41 (having a diameter of 20 mm) so that it may move in a direction indicated by an arrow Y, and has a circumference of 400 mm which corresponds to the sum of length (298 mm) of an A4 size sheet which is a maximum size in recording sheets employed in this printer and a value (102 mm) longer than half of a circumference of a 30 mm-diameter photosensitive drum (as will be described later in detail) by a preselected value.

The first transfer roller 39 has a resistance of $10^7$ Ωcm, and is urged against a photoconductor 46 (not shown) through the intermediate transfer belt 38 under a pressure of 1.0 kg. A third transfer roller 47 (not shown) which has the same construction as that of the first transfer roller 39 engages the second transfer roller 40 through the intermediate transfer belt 38 so that it may follows rotation of the second transfer roller 40.

The intermediate transfer belt unit 37 further includes a waste toner sensor 52 and a fur brush cleaner 53. The waste toner sensor is arranged in the waste toner chamber 44*b* to monitor the amount of toner particles collected therein and provides a sensor signal when the waste toner chamber 44*b* is filled with the toner particles. The brush cleaner 53 includes a conductive fur brush and applies voltage thereto for electrostatically removing toner particles adhering to a surface of the intermediate transfer belt 38. Generally, the intermediate transfer belt 38 will be degraded in long use due to such as deposition of toner particles on the surface thereof. The extreme degradation of the intermediate transfer belt 38 leads to partial lack of images or formation of white or black lines on images. Therefore, the intermediate transfer belt 38 is preferably replaced prior to reduction in image quality. It is, however, difficult to automatically detect the degradation of the intermediate transfer belt 38 in the printer. In this embodiment, the intermediate transfer belt 38 is, as stated above, arranged together with the waste toner chamber 44*b* in the unit housing 37*a* so that waste toner particles may be replaced along with the intermediate transfer belt 38. It is, therefore, advisable that the volume of the waste toner chamber 44*b* be so set that the waste toner chamber 44*b* may be filled with toner particles prior to the expiration of the lifetime of the intermediate transfer belt 38. This arrangement allows the waste toner sensor 52 to detect the waste toner chamber 44*b* being filled with toner particles before the intermediate transfer belt 38 is degraded to cause image defects to occur, for urging a printer operator to replace the intermediate transfer belt unit 37. Such an arrangement is also useful in an intermediate transfer belt designed to wrap a sheet of printing paper around its periphery.

When the intermediate transfer belt unit 37 is loaded into the printer casing 36, an image-forming operation being initiated, the first transfer roller 39 is pressed through the intermediate transfer belt 38 on the photoconductor 46 lying at the image-forming station 58 under a pressure of approximately 1.0 kg. Similarly, the second transfer roller 40 is biased against the third transfer roller 47 via the intermediate transfer belt 38.

A laser beam scanner 72 is disposed on an upper portion of the printer casing 36. The laser beam scanner 72 includes a semiconductor laser scanner motor 72*a*, a polygon mirror 72*b*, and a lens system 72*c*. The scanner 72 provides time-sequential electric pixel information signals in the form of a laser beam 59 which, in turn, is directed onto a mirror 75 arranged in the hollow shaft 57 through an aperture 73 defined between the image-forming units 54Bk and 54Y and an aperture 74 formed in the shaft 57. The beam reflected on the mirror 75 then enters the image-forming unit 54Bk through the exposure aperture 62 and travels horizontally through an optical path defined between the toner hopper 63 and the cleaner 71 to arrive at a developing station on a left side of the photoconductor 46 so that it scans in a direction of a generatrix of the photoconductor for exposure.

The third transfer roller 47 is arranged inside the front access cover 36A and above a sheet feed roller 76. The third transfer roller 47, as already mentioned, engages the intermediate transfer belt 38 to form a nip through which a copy sheet is fed by the sheet feed roller 76 along a sheet feed path.

A pair of fixing rollers 85*a* and 85*b* are arranged in an upper front chamber formed in the printer casing 36. The fixing roller 85*a* includes therein a halogen lamp 86. Around the fixing rollers 85*a* and 85*b*, a polyimide film 87 is wound which is used for the purpose of polishing a color image printed on a copy sheet. A backup roller 88 is arranged in engagement with the fixing roller 85*a*. A sheet-ejecting tray 89 is provided in a sheet outlet.

In operation, the black image-forming unit 54Bk is, as shown in FIG. 9, initially positioned at the image-forming station 58. The photoconductor 46 engages the first transfer roller 39 through the intermediate transfer belt 38 to bring its side portions into contact with the rollers 51.

The laser beam scanner 72 outputs a black light-signal (i.e., the laser beam 59) to the black image-forming unit 54Bk to form an electrostatic latent image on the photoconductor 46 which is, in turn, toned with black toner particles. The image-forming unit 54Bk then rotates the photoconductor 46 at a speed (a peripheral speed of 60 mm/s) equal to a traveling speed of the intermediate transfer belt 38 so that the black toner image formed on the photoconductor 46 is transferred to the intermediate transfer belt 38 under activities of the first transfer roller 39 to which a dc voltage of +1 kV is applied.

After completion of the transfer of the black toner image, the image-forming assembly 55 is, as shown in FIG. 9, turned by the motor 56 through an angle of 90 deg. in a direction indicated by Q, so that the image-forming unit 54C reaches the image-forming station 58. During the rotation of the image-forming assembly 55, component parts of each image-forming unit other than the photoconductor 46 are held out of engagement with the intermediate transfer belt 38.

Upon the image-forming unit 54C arriving at the image-forming station 58, the laser beam scanner 72 provides a cyan light-signal thereto to form a cyan toner image and transfers it to the intermediate transfer belt 38 in the same manner as mentioned above. During this process, the intermediate transfer belt 38 makes its complete turn and the timing of writing the cyan light-signal on the photoconductor 46 is regulated based on a sensor signal from the position sensor 45 so that the cyan toner image may be brought into superimposed registration with the black toner image transferred on the intermediate transfer belt 38 in the previous transfer cycle.

The same image-forming process as stated above is performed for magenta and yellow. In this manner, successive electrostatic latent images are developed with different colored toner particles and then transferred to the intermediate transfer belt 38 in superimposed registration with one another to form a multi-colored image thereon.

After the last yellow toner image has been transferred to the intermediate transfer belt 38, a copy sheet is fed from a sheet cassette (not shown) into a nip (i.e., a printing station) formed between the second transfer roller 40 and the third transfer roller 47 with proper timing so that the multi-colored image is printed thereon and then fixed by the fixing rollers 85*a* and 85*b*. The image-copied sheet is then ejected onto the sheet-ejecting tray 89. The toner particles remaining on the intermediate transfer belt 38 are cleaned by the brush cleaner 53 and collected in the waste toner chamber 44*b* formed in the intermediate transfer belt unit 37.

When the above printing operation is repeated about 30,000 cycles, the waste toner chamber 44*b* will be filled with toner particles. The waste toner sensor 52 then outputs a sensor signal indicative thereof, urging the printer operator to replace the intermediate transfer belt unit 37.

The maintenance of the image-forming units 54Bk, 54C, 54M, and 54Y and the intermediate transfer belt unit 37 will be discussed hereinafter with reference to FIG. 10.

For example, when the magenta image-forming unit 54M is replaced, the image-forming assembly 55 is rotated by the motor 56 to a non-operative position 90 so that the magenta image-forming unit 54M may be located behind the rear access cover 36C. In the non-operative position, each photoconductor 46 is out of engagement with the first transfer roller 39. The rear access cover 36C is then opened, unloading the magenta image-forming unit 54 therethrough in a direction, indicated by the reference letter Z, perpendicular to an axis of rotation of each photoconductor 46.

When the waste toner chamber 44*b* is filled with toner particles and it is required to replace the intermediate transfer belt unit 37, the motor 56 is likewise activated to rotate the image-forming assembly 55 into the non-operative position 90, moving the photoconductors 46 out of engagement with the first transfer roller 39. The front access cover 36A is then manually opened by the printer operator to unload the intermediate transfer belt unit 37 from the printer casing 36 in a direction X perpendicular to the axis of rotation of each photoconductor 46. A new intermediate transfer belt unit is subsequently loaded in place. During the loading of the new intermediate transfer belt unit, the photoconductors 46 do not hit on a first transfer roller of the new intermediate transfer belt unit because the image-forming assembly 55 is in the non-operative position 90, thereby preventing the photoconductors 46 from being damaged. Additionally, in the non-operative position 90, the photoconductors 46 are prevented from being degraded on exposure to light entering from an aperture formed by the front access cover 36A being opened.

Usually, it is necessary for a waste toner sensor for monitoring the mount of toner collected in a waste toner chamber to be cleaned regularly for maintaining high detection accuracy. In this embodiment, the waste toner sensor 52 is provided in the intermediate transfer belt unit 37 so that it may be replaced upon replacement of the intermediate transfer belt unit 37. This eliminates the need for cleaning the waste toner sensor 52 for easy maintenance.

Figure 12:
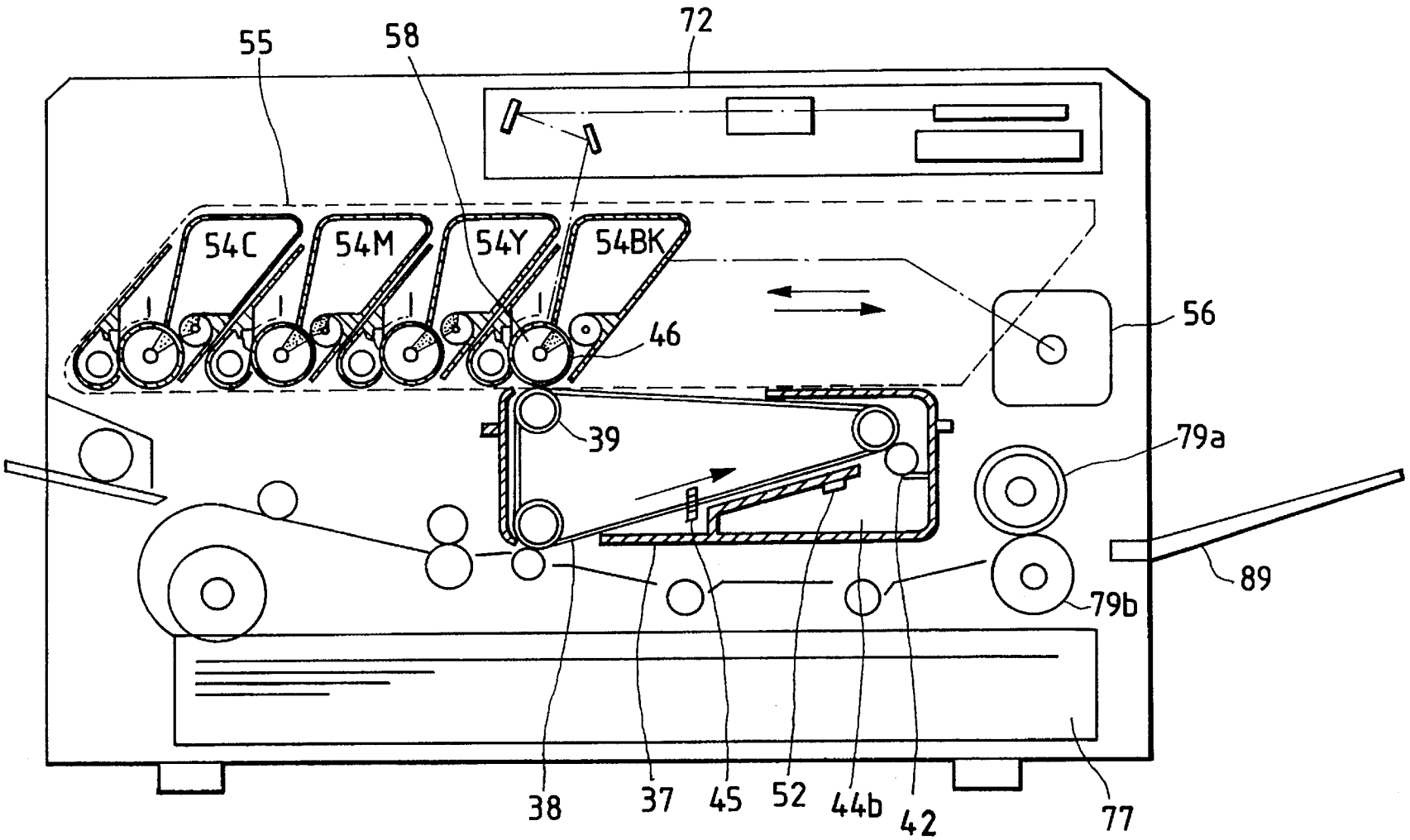
FIG. 12 is a cross-sectional view which shows a modification of a printer of a second embodiment.
Figure 13:
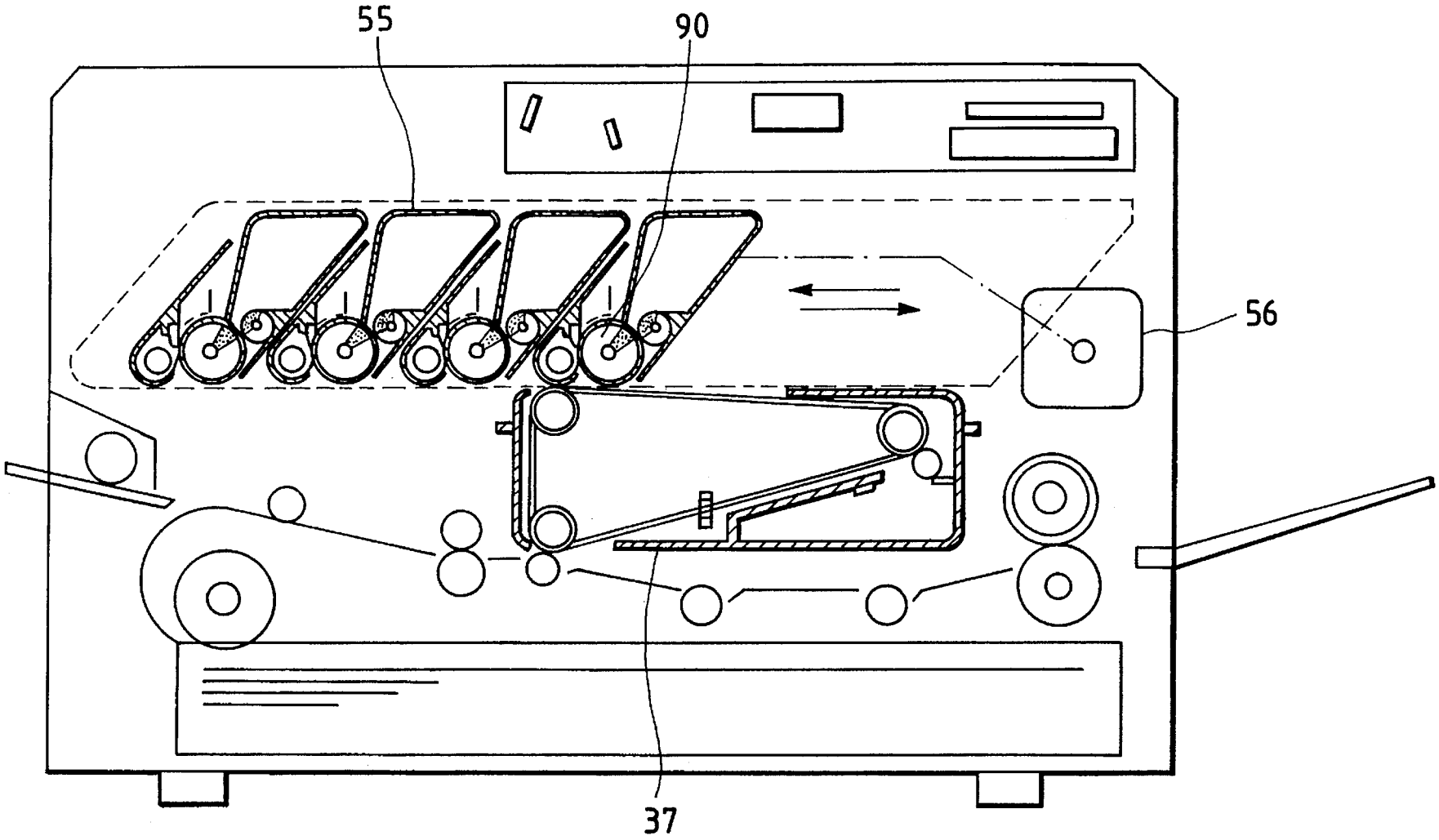
FIG. 13 is a cross-sectional view which shows the printer of FIG. 12 lying at an inoperative position.

Referring to FIGS. 12 and 13, there is shown a modification of the second embodiment, as discussed above, which is different therefrom in that an image-forming assembly 55 has four image-forming units 54Bk, 54Y, 54M, and 54C arranged straight and horizontally. Like numbers refer to like parts as explained in the above embodiment and explanation thereof in detail will be omitted here.

The image-forming assembly 55 is designed to be movable along a given path of travel extending horizontally to displace each image-forming unit 54Bk, 54Y, 54M, and 54C between an operative position, as shown in FIG. 12, in engagement with a first transfer roller 39 of an intermediate transfer belt unit 37 and inoperative positions, as shown in FIG. 13, in disengagement therefrom.

When replacing one of the image-forming units 54Bk, 54Y, 54M, and 54C, the printer is stopped, the image-forming assembly 55 is moved into the inoperative position, and then one of the image-forming units is withdrawn in a direction perpendicular to the drawing (i.e., parallel to an axis of rotation of each photoconductor) from an access cover (not shown).

Referring to FIGS. 14 to 17, there is shown a third embodiment of the multi-color electrophotographic printer.

Figure 16:
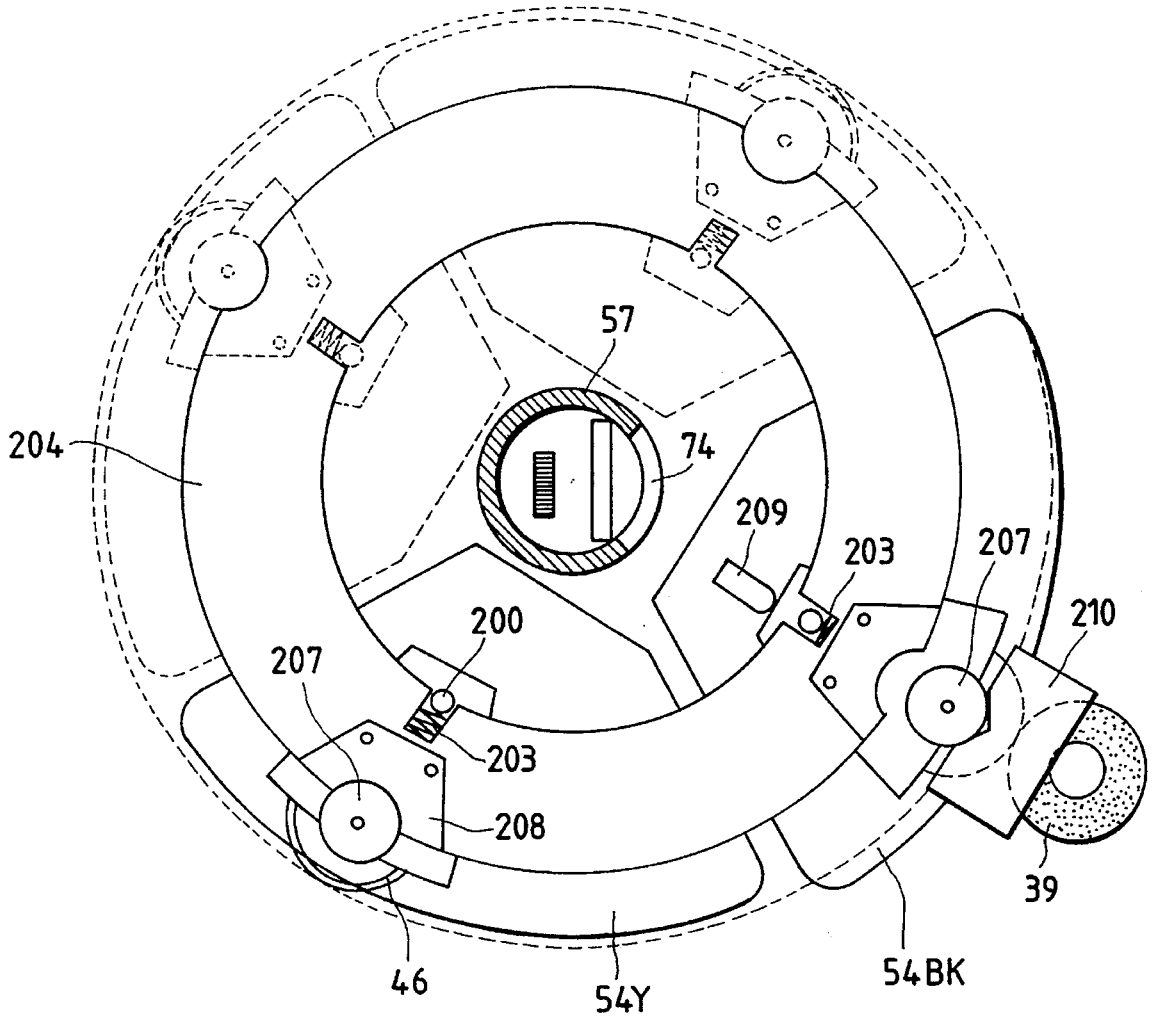
FIG. 16 is a cross-sectional view which shows a structure of an image-forming assembly designed to move each image-forming unit in a radial direction into an operative position.
Figure 17:
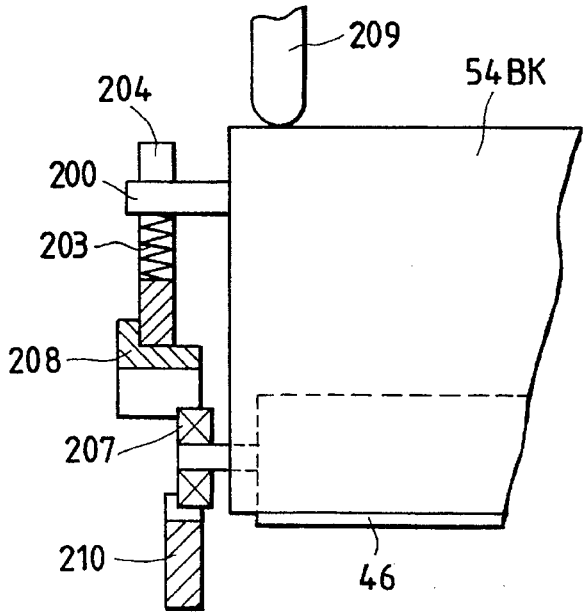
FIG. 17 is partial side view of FIG. 16.

The printer shown represents a modification as shown in FIG. 9 and is different therefrom in a structure of an image-forming assembly 55 shown in FIGS. 16 and 17.

An image-forming assembly 55 has image-forming units 54Bk, 54C, 54M, and 54Y supported by a support ring 204 at regular intervals. Each image-forming unit has a bearing 207, a pin 200, and a spring 203. Each bearing 207 is mounted coaxially with each photoconductor 46, and engages a recessed portion formed in the periphery of the support ring 204, while each pin 200 is urged by the spring inward to hold each image-forming unit at an inoperative position where the photoconductor 46 is out of engagement with a first transfer roller 39 of an intermediate transfer belt unit 37. When moving one of the image-forming units 54Bk, 54C, 54M, and 54Y into an operative position, an actuator (not shown) is activated to push a pressure lever 209 against a spring force of the spring 203 to displace the bearing 207 in a radial direction into engagement with a V-shaped groove formed in a stopper 210, establishing engagement between the one of the image-forming units and the first transfer roller 39.

Additionally, it is also desirable that the periphery of the photoconductor 46 of each image-forming unit 54Bk, 54C, 54M, and 54Y be brought into direct engagement with such a bearing to have the image-forming unit assume the operative position. This arrangement eliminates the influence caused by an eccentric of each photoconductor 46.

Figure 14:
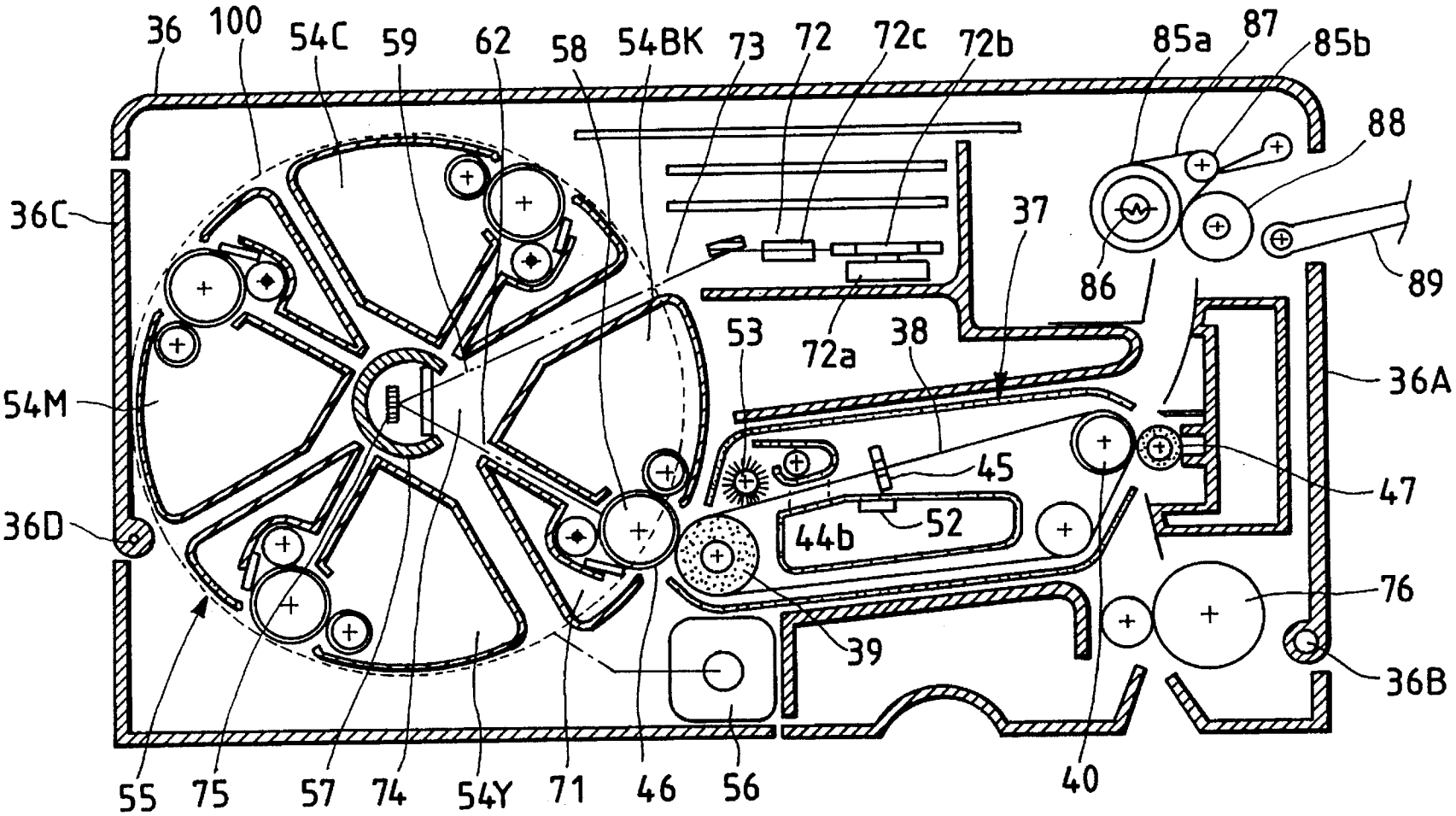
FIG. 14 is a cross-sectional view which shows a third embodiment of a multi-color electrophotographic printer of the invention.

In a black toner image-forming operation, for example, upon reaching an image-forming station 58, a black image-forming unit 54Bk is, as shown in FIG. 14, shifted out of a circle 100, shown by a broken line, defined around an outermost surface of each photoconductor 46, to an operative position, bringing a photoconductor 46 into engagement with a first transfer roller 39 of an intermediate transfer belt unit 37. A laser beam scanner 72 then outputs a black light-signal (i.e., a laser beam 59) to the black image-forming unit 54Bk to form an electrostatic latent image on the photoconductor 46 which is, in turn, toned with black toner particles. The image-forming unit 54Bk then rotates the photoconductor 46 at a speed (a peripheral speed of 60 mm/s) equal to a traveling speed of an intermediate transfer belt 38 so that the black toner image formed on the photoconductor 46 is transferred to the intermediate transfer belt 38 under activities of the first transfer roller 39 to which a dc voltage of +1 kV is applied.

Figure 15:
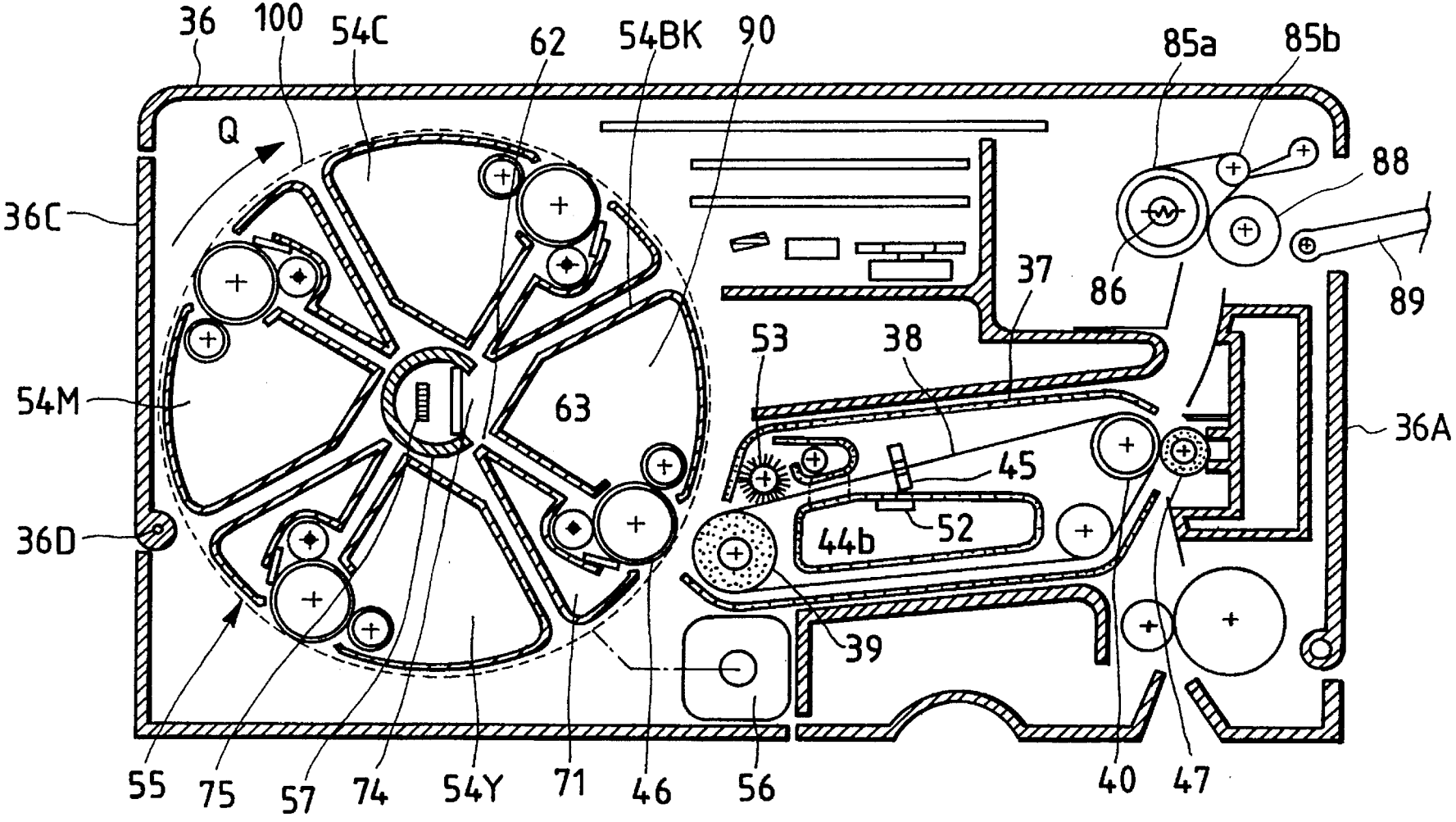
FIG. 15 is a cross-sectional view which illustrates an image-forming assembly being placed in an inoperative position for replacement.

After completion of the transfer of the black toner image, the black image-forming unit 54Bk is, as shown in FIG. 15, returned to an inoperative position inside the circle 100 and then advanced by a motor 56 through an angle of 90 deg. in a direction indicated by Q, so that the cyan image-forming unit 54C reaches the image-forming station 58. During the displacement of the image-forming assembly 55, component parts of each image-forming unit other than the photoconductor 46 are held out of engagement with the intermediate transfer belt 38.

Upon arriving at the image-forming station 58, the cyan image-forming unit 54C is, similar to the black image-forming unit 54Bk, shifted outward into engagement with the first transfer roller 39. The laser beam scanner 72 then provides a cyan light-signal to the photoconductor 46 of the cyan image-forming unit 54C form a cyan toner image and transfers it to the intermediate transfer belt 38 in the same manner as mentioned above. During this process, the intermediate transfer belt 38 makes its complete turn and the timing of writing the cyan light-signal on the photoconductor 46 is adjusted based on a sensor signal from the position sensor 45 so that the cyan toner image may be brought into superimposed registration with the black toner image transferred on the intermediate transfer belt 38 in the previous transfer cycle.

The same image-forming process as stated above is performed for magenta and yellow. In this manner, successive electrostatic latent images are developed with different colored toner particles and then transferred to the intermediate transfer belt 38 in superimposed registration with one another to form a multi-colored image thereon.

After the last yellow toner image has been transferred to the intermediate transfer belt 38, a copy sheet is fed from a sheet cassette (not shown) into a nip (i.e., a printing station) formed between the second transfer roller 40 and the third transfer roller 47 with proper timing so that the multi-colored image is printed thereon and then fixed by the fixing rollers 85*a* and 85*b*. The image-copied sheet is then ejected onto the sheet-ejecting tray 89. The toner particles remaining on the intermediate transfer belt 38 are cleaned by the brush cleaner 53 and then collected in the waste toner chamber 44*b* formed in the intermediate transfer belt unit 37.

When the above printing operation is repeated about 30,000 cycles, the waste toner chamber 44*b* will be filled with toner particles. The waste toner sensor 52 then outputs a sensor signal indicative thereof, urging the printer operator to replace the intermediate transfer belt unit 37.

For example, when the magenta image-forming unit 54M is replaced, the image-forming assembly 55 is rotated by the motor 56 to move the magenta image-forming unit 54M behind the rear access cover 36C while the black image-forming unit 54Bk lies in the non-operative position 90. The rear access cover 36C is then opened, unloading the magenta image-forming unit 54 therethrough in a direction, indicated by the reference letter Z, perpendicular to an axis of rotation of each photoconductor 46.

When the waste toner chamber 44*b* is filled with toner particles and it is required to replace the intermediate transfer belt unit 37, the image-forming assembly 55 is moved into the non-operative position 90, displacing all the photoconductors 46 out of engagement with the first transfer roller 39. The front access cover 36A is then opened by the printer operator to unload the intermediate transfer belt unit 37 from the printer casing 36 in a direction X perpendicular to the axis of rotation of each photoconductor 46. A new intermediate transfer belt unit is subsequently loaded in place. During the loading of the new intermediate transfer belt unit, the photoconductors 46 do not hit on a first transfer roller of the new intermediate transfer belt unit because the image-forming assembly 55 is in the non-operative position 90, thereby preventing the photoconductors 46 from being damaged. Additionally, in the non-operative position 90, each photoconductor 46 is prevented from being degraded on exposure to light entering from an aperture formed by the front access cover 36A being opened.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended clams.

What is claimed is:

1. A multi-color electrophotographic apparatus comprising:

a casing;

a rotary image-forming assembly including a plurality of image-forming units each including a photoconductor and a developer having a toner of a single different color for forming a different color toner image disposed about a common axis, each photoconductor being rotatable about a given axis of rotation, said rotary image-forming assembly being movable between operative and inoperative positions, the operative position being such that each image-forming unit is displaced outward of a periphery of said image-forming assembly into engagement with a transfer belt at an image forming station to transfer the toner image formed thereon, in registration with one another, to said transfer belt for forming a multi-colored image, the inoperative position being such that each image-forming unit lies inside the periphery of said image-forming assembly out of engagement with said transfer belt;

driving means for rotating said image-forming assembly about said common axis to move said image-forming units, in sequence, to an image-forming station;

exposure means for providing a light-signal to said image-forming assembly;

optical orientation means, arranged at a central portion of said rotary image-forming assembly, for orienting the light-signal from said exposure means toward the photoconductor of each image-forming unit positioned at the image-forming station for forming a toner image of a different color thereon;

transfer means for transferring the multi-color toner image formed on said transfer belt to a recording sheet; and a transfer belt unit having disposed therein said transfer belt and a cleaner for cleaning a surface of said transfer belt, said transfer belt unit being arranged in said casing detachably therefrom in a direction substantially perpendicular to the given axis of rotation of the photoconductor of each image-forming unit.

2. A multi-color electrophotographic apparatus as set forth in claim 1, wherein said transfer belt unit further including a waste toner chamber for storing therein waste toner deposited on said transfer belt cleaned by the cleaner.

3. A multi-color electrophotographic apparatus as set forth in claim 2, further comprising a toner sensor mounted in said transfer belt unit to monitor the amount of the waste toner collected in the waste toner chamber.

4. A multi-color electrophotographic apparatus as set forth in claim 3, further comprising a position sensor for detecting an image-forming starting position of said transfer belt to provide a position signal indicative thereof, said transfer belt being controlled in response to the position signal to transfer thereon the toner image formed on each photoconductor in registration with one another for forming the multi-colored image.

5. A multi-color electrophotographic apparatus as set forth in claim 4, wherein the position sensor is disposed within said transfer belt unit.

6. A multi-color electrophotographic apparatus as set forth in claim 1, wherein each image-forming unit assumes the inoperative position when the apparatus is out of an image-forming operation for allowing said image-forming assembly to be unloaded from an apparatus casing.

7. A multi-color electrophotographic apparatus comprising:

a casing having an access cover;

image-transferring means for transferring a multi-colored image to a recording sheet; and an image-forming assembly having a plurality of image-forming units, each unit including a photoconductor and a developer storing therein toner of a single color for forming a single color toner image on each photoconductor, said image-forming assembly being arranged to be movable between operative and inoperative positions, the operative position being such that each image-forming unit lies at an image-forming station with the photoconductor thereof in engagement with said image-transferring means to transfer the toner image formed thereon in registration with each other to said image-transferring means for forming the multi-colored image, the inoperative position being such that all the photoconductors of said image-forming assembly are out of engagement with said image transferring means for allowing said image-transferring means to be unloaded from said casing through the access cover, said image-transferring means includes a transfer belt for transferring at the image-forming station the toner image formed on each photoconductor thereto in registration with one another for forming thereon the multi-colored toner image, a first transfer roller bringing the transfer belt into engagement with each photoconductor lying at the image-forming station, a second transfer roller arranged to urge the transfer belt for forming a nip between the transfer belt and a third transfer roller provided in said casing through which a recording medium passes to transfer the multi-colored toner image formed on the transfer belt to the recording medium, a fourth roller arranged coaxially with the first transfer roller, said fourth roller having a smaller diameter than that of the first transfer roller to restrict a degree of engagement of the first transfer roller with each photoconductor through the transfer belt at the image-forming station, and a tension roller for providing tension to the transfer belt stretched to a given degree.

8. A multi-color electrophotographic apparatus as set forth in claim 7, wherein said image-forming assembly has the image-forming units arranged in a circle, and a driving means for rotating said image-forming assembly to move the image-forming units, in sequence, between the operative position and the inoperative position, each image-forming unit supporting the photoconductor rotatably about an axis of rotation, said image-transferring means being so arranged in said casing as to be withdrawn through the access cover in a direction perpendicular to the axis of rotation of each photoconductor.

9. A multi-color electrophotographic apparatus as set forth in claim 7, wherein said image-forming assembly has the image-forming units arranged in a straight line, and driving means for moving said image-forming assembly along a given linear path to displace the image-forming units, in sequence linear path to displace the image-forming units, in sequence between the operative position and the inoperative position, each image-forming unit supporting the photoconductor rotatably about, an axis of rotation, said image-forming assembly being movable through the access cover in a direction parallel to the axis of rotation of each photoconductor.

10. A multi-color electrophotographic apparatus as set forth in clam 7, wherein sad image-forming assembly has the image-forming units arranged in a circle, and driving means being provided for rotating sad image-forming assembly to move the image-forming units sequentially into alignment with said image-transferring means and displacing each image-forming unit outward in a radial direction into engagement with sad image-transferring means to assume the operative position.

11. A multi-color electrophotographic apparatus as set forth in claim 7, further comprising a waste toner chamber for storing therein waste toner deposited on the transfer belt, and a waste toner sensor for monitoring the amount of the waste toner stored in the waste toner chamber.

12. A transfer belt unit for use in a multi-color electrophotographic apparatus including an image-forming assembly having a plurality of image-forming units each including a photoconductor and a developer having toner of a single different color for forming a different color toner image on the photoconductor, and driving means for moving said image-forming assembly to displace said image-forming units, in sequence, to an image-forming station, and a transfer member unit comprising: a transfer belt for transferring at the image-forming station the toner image formed on each photoconductor thereto in registration with one another forming a multi-color toner image, a first transfer roller bringing the transfer belt into engagement with each photoconductor that is positioned at the image-forming station, a second transfer roller arranged to urge the transfer belt to form a nip between the transfer belt and transferring means of a multi-color electrophotographic apparatus through which a recording medium passes, to transfer the multi-color toner image formed on the transfer belt to the recording medium, a third roller arranged coaxially with the first transfer roller, said roller having a smaller diameter than that of the first transfer roller to restrict a degree of engagement of the first transfer roller with each photoconductor through the transfer belt at the image-forming station, and a tension roller for providing tension to the transfer belt for maintaining the transfer belt stretched to a given degree.

13. A transfer belt unit as set forth in claim 12, wherein said first transfer roller is made of a conductive and elastic material.

14. A transfer belt unit as set forth in claim 12, wherein said tension roller is supported by a shaft which is so mounted on a housing of the transfer belt unit as to be displaced for maintaining a given degree of tension over the transfer belt.

15. A transfer belt unit as set forth in claim 12, wherein each image-forming unit is so mounted in said image-forming assembly as to be displaced along a given path of travel extending in a radial direction of the image-forming assembly, further provided with means for urging each image-forming unit which has moved to the image-forming station along the given path of travel into engagement with the image-transferring means to assume the operative position.

* * * * *